US007735557B2

(12) United States Patent
Mailand et al.

(10) Patent No.: US 7,735,557 B2
(45) Date of Patent: Jun. 15, 2010

(54) WIRELINE SLIP HANGING BYPASS ASSEMBLY AND METHOD

(75) Inventors: Jason C. Mailand, The Woodlands, TX (US); Lonnie Christopher West, The Woodlands, TX (US); Adrian V. Saran, Kingwood, TX (US); Glenn A. Bahr, Cypress, TX (US); Thomas G. Hill, Conroe, TX (US)

(73) Assignee: BJ Services Company, U.S.A., Houston, TX (US)

( * ) Notice: Subject to any disclaimer, the term of this patent is extended or adjusted under 35 U.S.C. 154(b) by 167 days.

(21) Appl. No.: 11/821,289

(22) Filed: Jun. 22, 2007

(65) Prior Publication Data

US 2008/0000642 A1 Jan. 3, 2008

Related U.S. Application Data

(60) Provisional application No. 60/805,651, filed on Jun. 23, 2006.

(51) Int. Cl.
*E21B 34/10* (2006.01)
*E21B 19/02* (2006.01)

(52) U.S. Cl. ..... 166/305.1; 166/319; 166/332.1

(58) Field of Classification Search ..... 166/115, 166/305.1, 373, 332.4, 332.1
See application file for complete search history.

(56) References Cited

U.S. PATENT DOCUMENTS 3,675,720 A * 7/1972 Sizer ..... 166/371
4,079,998 A 3/1978 Huff et al. ..... 299/4
2006/0021750 A1 * 2/2006 Lugtmeier et al. ..... 166/169

FOREIGN PATENT DOCUMENTS

| | | |
|---|---|---|
| GB | 2111562 | 7/1983 |
| WO | WO 2004076797 | 9/2004 |
| WO | WO 2006042060 | 4/2006 |
| WO | WO 2006069247 | 6/2006 |
| WO | WO 2006/133351 A2 * | 12/2006 |
| WO | WO 2006133351 | 12/2006 |

OTHER PUBLICATIONS

PCT International Search Report and Written Opinion mailed Jan. 24, 2008, for corresponding PCT/US2007/014558.

* cited by examiner

*Primary Examiner*—David J Bagnell
*Assistant Examiner*—James G Sayre
(74) *Attorney, Agent, or Firm*—Zarian Midgley & Johnson PLLC

(57) ABSTRACT

Bypass assembly 100 includes stinger 150 received by receptacle bore 172 of tubular receiver 120 attached to tube 106. Bypass pathway 140 connects stinger port(s) (158, 158') to slip hanger 122 supported hydraulic conduit 108 to bypass the tube 106. Tube 106 can be a subsurface safety valve or hydraulic nipple anchored within production tubing. Bypass assembly 200 includes upper 202 and lower 203 hydraulic nipples in production tubing 210, with respective tubular anchor seal assemblies (220, 230) engaged therein. Bypass pathway 214 connects hydraulic conduit 208 to slip hanger 242 supported hydraulic conduit 216 to bypass tubular anchor seal assemblies (220, 230). Bypass assembly 300 includes upper 302 and lower 303 hydraulic nipples in production tubing 310, with respective tubular anchor seal assemblies (320, 330) engaged therein. Bypass passage 318 connects stinger 350 to slip hanger 342 supported hydraulic conduit 316 to bypass tubular anchor seal assemblies (320, 330).

20 Claims, 14 Drawing Sheets

WIRELINE SLIP HANGING BYPASS ASSEMBLY AND METHOD

CROSS REFERENCE TO RELATED APPLICATION

This application is a non-provisional patent application claiming priority to U.S. Provisional Application Ser. No. 60/805,651, entitled, "Wireline Slip Hanging Bypass Assembly and Method," by Jason C. Mailand, Lonnie Christopher West, Adrian V. Saran, Glenn A. Bahr, and Thomas G. Hill, Jr., filed Jun. 23, 2006, hereby incorporated by reference in its entirety herein.

BACKGROUND OF THE INVENTION

The present invention generally relates to subsurface apparatuses used in the petroleum production industry. More particularly, the present invention relates to an apparatus and method to fluidicly bypass subsurface apparatuses, such as a subsurface safety valve, to inject a fluid to a downhole location.

Various obstructions exist within strings of production tubing in subterranean well bores. Downhole components such as valves, whipstocks, packers, plugs, sliding side doors, flow control devices, expansion joints, on/off attachments, landing nipples, dual completion components, and other tubing retrievable completion equipment can obstruct the deployment of capillary tubing strings to subterranean production zones and/or interfere with the operation of the downhole equipment. One or more of these types of obstructions or tools are shown in the following United States patents which are incorporated herein by reference: Young, U.S. Pat. No. 3,814,181; Pringle, U.S. Pat. No. 4,520,870; Carmody et al., U.S. Pat. No. 4,415,036; Pringle, U.S. Pat. No. 4,460,046; Mott, U.S. Pat. No. 3,763,933; Morris, U.S. Pat. No. 4,605,070; and Jackson et al., U.S. Pat. No. 4,144,937. Particularly, in circumstances where stimulation operations are to be performed on non-producing hydrocarbon wells, the obstructions stand in the way of operations that are capable of obtaining continued production out of a well long considered depleted. Most depleted wells are not lacking in hydrocarbon reserves, rather the natural pressure of the hydrocarbon producing zone is at a pressure less than the hydrostatic head of the production column. Often, secondary recovery and artificial lift operations will be performed to retrieve the remaining resources, but such operations are often too complex and costly to be performed on all wells. Fortunately, many new systems enable continued hydrocarbon production without costly secondary recovery and artificial lift mechanisms. Many of these systems utilize the periodic injection of various chemical substances into the production zone to stimulate the production zone thereby increasing the production of marketable quantities of oil and gas. However, obstructions in the wells often impede the deployment of a hydraulic injection conduit, typically capillary tubing, to the production zone so that the stimulation chemicals can be injected. Further, the deployment of a hydraulic injection conduit can impede the operation of any existing or future desired downhole components. For example, capillary tubing extending through the flow control member of a subsurface safety valve can hinder the operation of the flow control member or actuation of the flow control member can result in the severing of the capillary tubing. While many of these obstructions are removable, they are typically components required to maintain production of the well so permanent removal is not feasible.

The most common of these obstructions found in production tubing strings are subsurface safety valves, however the invention is not so limited. Subsurface safety valves, hydraulic bypasses, and associated improvements thereto are described in several patent applications incorporated herein by reference, including: U.S. Ser. No. 60/522,499 filed Oct. 7,2004; U.S. Ser. No. 60/522,360 filed Sep. 20, 2004; U.S. Ser. No. 60/522,498 filed Oct. 7, 2004; U.S. Ser. No. 60/522,500 filed Oct. 7, 2004; U.S. Ser. No. 60/593,216 filed Dec. 22, 2004; U.S. Ser. No. 60/593,217 filed Dec. 22, 2004; U.S. Ser. No. 60/595,137 filed Jun. 8, 2005; U.S. Ser. No. 60/595,138 filed on Jun. 8, 2005; U.S. Ser. No. 10/708,338 filed on Feb. 25, 2004; International App. No. PCT/US05/015081 filed on May 2, 2005; International App. No. PCT/US05/33515 filed on Sep. 20, 2005; International App. No. PCT/US05/035601 filed on Oct. 7, 2005; International App. No. PCT/US05/036065 filed on Oct. 7, 2005; International App. No. PCT/US05/046622 filed on Oct. 7, 2005; and International App. No. PCT/US05/047007 filed on Dec. 22, 2005.

Subsurface safety valves are typically installed in strings of production tubing deployed to subterranean wellbores to prevent the escape of fluids from the well bore to the surface. Absent safety valves, sudden increases in downhole pressure can lead to disastrous blowouts of fluids into the atmosphere. Therefore, numerous drilling and production regulations throughout the world require safety valves be in place within strings of production tubing before certain operations are allowed to proceed.

Safety valves allow communication between the isolated zones and the surface under regular conditions but are designed to shut when undesirable conditions exist. One popular type of safety valve is commonly referred to as a surface controlled subsurface safety valve (SCSSV). SCSSVs typically include a flow control member generally in the form of a circular or curved disc, a rotatable ball, or a poppet, that engages a corresponding valve seat to isolate zones located above and below the flow control member in the subsurface well. The flow control member is preferably constructed such that the flow through the valve seat is as unrestricted as possible. Typically, SCSSVs are located within the production tubing and isolate production zones from upper portions of the production tubing, Optimally, SCSSVs function as high-clearance check valves, in that they allow substantially unrestricted flow therethrough when opened and completely seal off flow in one direction when closed. Particularly, production tubing safety valves prevent fluids from production zones from flowing up the production tubing when closed but still allow for the flow of fluids (and movement of tools) into the production zone from above (e.g., downstream).

SCSSVs normally have a control line extending from the valve, said control line disposed in an annulus formed by the well casing or wellbore and the production tubing, and extending from the surface. SCSSVs can anchor in a hydraulic nipple of a string of production tubing, the hydraulic nipple providing communication with a control line. Pressure in the control line opens the valve allowing production or tool entry through the subsurface safety valve. Any loss of pressure in the control line typically closes the valve, prohibiting flow from the subterranean formation to the surface.

Flow control members are often energized with a biasing member (spring, hydraulic cylinder, gas charge and the like, as well known in the industry) such that in a condition with no pressure, the valve remains closed. In this closed position, any build-up of pressure from the production zone below will thrust the flow control member against the valve seat and act to strengthen any seal therebetween. During use, flow control members are opened to allow the free flow and travel of production fluids and tools therethrough.

Formerly, to install a chemical injection conduit around a production tubing obstruction, the entire string of production tubing had to be retrieved from the well and the injection conduit incorporated into the string prior to replacement often costing millions of dollars. This process is not only expensive but also time consuming, thus it can only be performed on wells having enough production capability to justify the expense. A simpler and less costly solution would be well received within the petroleum production industry and enable wells that have been abandoned for economic reasons to continue to operate.

SUMMARY OF THE INVENTION

The deficiencies of the prior art are addressed by an assembly to inject a fluid into a well. More specifically, a bypass assembly to fluidicly bypass a downhole component(s) located within a string of production tubing to allow injection below said downhole component(s).

A bypass assembly to inject a fluid into a well can include a tubular receiver having a longitudinal bore, the longitudinal bore housing a receiving body with a receptacle bore, a stinger removably received by the receptacle bore, the stinger having a fluid passage therein in communication with a stinger port on an outer surface of the stinger, and a bypass pathway extending from a first bypass port in the receptacle bore to a second bypass port on an outer surface of the tubular receiver, the stinger port in communication with the first bypass port when the stinger is engaged within the receptacle bore. Tubular receiver, and anything attached thereto, can be disposed to a landing profile in a string of production tubing via wireline operation. Receiving body can be sized such that fluid flow through the longitudinal bore of the tubular receiver is possible, independent of the presence of the stinger.

The stinger can have a cylindrical body section and/or a conical nose section. The cylindrical body section can have the stinger port formed therein. A bypass assembly can include a set of radial seals circumferential the cylindrical body section, the stinger port between the set of radial seals and the first bypass port of the bypass pathway between the set of radial seals. The tubular receiver can include an anchor assembly on a proximal end of the tubular receiver, the anchor assembly received by a landing profile of the well. The tubular receiver can be disposed inline with a production tubing in the well. A tube or other body with a longitudinal bore can be attached to a distal end of the tubular receiver, the longitudinal bore of the tube or body in communication with the longitudinal bore of the tubular receiver. The tube can be, or include in the longitudinal bore thereof, a subsurface safety valve and/or a hydraulic nipple. A hydraulic conduit can extend from the second bypass port to a second location adjacent a distal end of the tube. Hydraulic conduit can be capillary tubing. The tubular receiver and/or tube can be deployable by wireline. A slip hanger can be disposed in a recess in the outer surface of the tubular receiver, the slip hanger retaining a proximal end of the hydraulic conduit. Tubular receiver and/or stinger can be deployed via wireline operation.

A groove can be formed in at least one of the outer surface of the tubular receiver and an outer surface of the tubular, the groove housing a portion of the hydraulic conduit to protect from contact with the bore of the production tubing. The bypass assembly can include a ring or skid on the distal end of the tube, the ring or skid having a groove housing a portion of the hydraulic conduit.

A conical nose section of the stinger can include a hardened material coating or be made from hardened material, for example, carbide. An upstream portion of the receiving body can include a hardened material coating or be made from hardened material. The nose section and/or the upstream portion of the receiving body can be selected to minimize the drag and/or abrasion experienced by receiving body due to well (e.g., production) fluid flow through the production tubing.

A plurality of alignment fins can be disposed on the outer surface of the stinger to align the stinger with the receptacle bore during insertion therein. The leading edge of the plurality of alignment fins can contact the bore of the production tubing to facilitate alignment. The plurality of alignment fins can be aluminum. A mechanical lock can be included between the outer surface of the stinger and the receptacle bore to retain the stinger therein.

A method to inject a fluid into a well can include installing an anchor assembly connected to a tubular receiver having a longitudinal bore into a landing profile of the well, the longitudinal bore housing a receiving body with a receptacle bore, disposing a stinger from a surface location, through the well, into the receptacle bore of the receiving body, the stinger providing a fluid passage in communication with the surface location and a stinger port on an outer surface of the stinger disposed between a set of radial seals, and injecting the fluid through the fluid passage of the stinger, out of the stinger port and into an annulus between the receptacle bore and the stinger as bounded by the set of radial seals, into a first bypass port in the receptacle bore in communication with a bypass pathway, and out a second bypass port on an outer surface of the tubular receiver. A distal end of the receiver can be attached to a tube, a longitudinal bore of the tube in communication with the longitudinal bore of the tubular receiver. The tube can be or include a subsurface safety valve and/or a hydraulic nipple.

The step of injecting the fluid can include injecting the fluid from the second bypass port into a hydraulic conduit, or capillary tubing, extending from the second bypass port to a second location upstream of a distal end of the tube to bypass the longitudinal bore of the tube and thus anything disposed therein. A hydraulic conduit can be suspended from a slip hanger disposed in a recess in the outer surface of the tubular receiver.

The method to inject the fluid into the well can include flowing a well fluid through a void formed between an assembly of the stinger and the receiving body and the longitudinal bore of the tubular receiver. The well fluid can be flowed at a rate sufficient to abradably remove an alignment fin disposed on the outer surface of the stinger. Additionally, alignment fin materials (such as aluminum alloys) can be selected to dissolve in the wellbore environment. The stinger can be removed from the receptacle bore when desired.

In another embodiment, a bypass assembly can include a production tubing in a wellbore having an upper and a lower hydraulic nipple, an upper tubular anchor seal assembly engaged within the upper hydraulic nipple, a lower tubular anchor seal assembly engaged within the lower hydraulic nipple, an upper hydraulic control line extending from a surface location to the upper hydraulic nipple, a lower hydraulic control line extending from the surface location to the lower hydraulic nipple, a first hydraulic conduit extending from the surface location to a first bypass port in a bore of the lower hydraulic nipple, the first bypass port disposed between a set for radial seals, a second hydraulic conduit extending from a bypass pathway in the lower tubular anchor seal assembly to a location upstream of a distal end of the lower tubular anchor seal assembly, and the bypass pathway in communication with the second hydraulic conduit and a second bypass port in an outer surface of the lower tubular anchor seal assembly, wherein the second bypass port is in communication with an annulus formed between the lower tubular anchor seal assembly and the bore of the lower hydraulic nipple as bounded by the set of radial seals. The bypass assembly can include a slip hanger disposed in a recess in the outer surface of the lower tubular anchor seal assembly, the slip hanger retaining a proximal end of the second hydraulic conduit.

The lower tubular anchor seal assembly can include a subsurface safety valve having a flow control member in communication with a second port on the outer surface of the lower tubular anchor seal assembly, the second port in communication with an annulus formed between the lower tubular anchor seal assembly and the lower hydraulic nipple as bounded by a second set of radial seals. The first and second sets of radial seals can have at least one seal in common. The upper tubular anchor seal assembly can include a subsurface safety valve having a flow control member in communication with a port on an outer surface of the upper tubular anchor seal assembly, the port in communication with an annulus formed between the upper tubular anchor seal assembly and the upper hydraulic nipple as bounded by a second set of radial seals. The lower tubular anchor seal assembly can include a second lower hydraulic nipple therein in communication with the lower hydraulic control line. The upper tubular anchor seal assembly can include a second upper hydraulic nipple therein in communication with the upper hydraulic control line.

A method to inject a fluid into a well can include providing a production tubing in a wellbore having an upper and a lower hydraulic nipple, the upper hydraulic nipple in communication with an upper hydraulic control line extending from a surface location and the lower hydraulic nipple in communication with a lower hydraulic control line extending from the surface location, installing an upper tubular anchor seal assembly into the upper hydraulic nipple, installing a lower tubular anchor seal assembly into the lower hydraulic nipple, injecting the fluid from the surface location through an annulus formed between the lower tubular anchor seal assembly and a bore of the lower hydraulic nipple as bounded by a set of radial seals, into a second bypass port between the set of radial seals on an outer surface of the lower tubular anchor seal assembly, into a bypass pathway in the lower tubular anchor seal assembly, and into a second hydraulic conduit in communication with the bypass pathway, a distal end of the second hydraulic conduit upstream of a distal end of the lower tubular anchor seal assembly. The method can include suspending the second hydraulic conduit from a slip hanger disposed in a recess in the outer surface of the lower tubular anchor seal assembly. The method can include actuating a flow control member of a subsurface safety valve disposed in the upper tubular anchor seal assembly with the upper hydraulic control line. The method can include actuating a flow control member of a subsurface safety valve disposed in the lower tubular anchor seal assembly with the lower hydraulic control line. At least one of the installing steps can be via wireline.

In yet another embodiment, a bypass assembly can include a production tubing in a wellbore having an upper and a lower hydraulic nipple, an upper tubular anchor seal assembly engaged within the upper hydraulic nipple, a lower tubular anchor seal assembly engaged within the lower hydraulic nipple, an upper hydraulic control line extending from a surface location to the upper hydraulic nipple, a lower hydraulic control line extending from the surface location to the lower hydraulic nipple, a first hydraulic conduit extending from the surface location to a stinger, the stinger removably received by a receptacle bore of a receiving body housed in a bore of the upper tubular anchor seal assembly and the first hydraulic control line in communication with a stinger port on an outer surface of the stinger, a bypass passage connecting the upper hydraulic nipple to the lower hydraulic nipple, the stinger port in communication with the upper hydraulic nipple, and a proximal end of a second hydraulic conduit connected to the lower tubular anchor seal assembly and in communication with the lower hydraulic nipple, a distal end of the second hydraulic conduit upstream of a distal end of the lower tubular anchor seal assembly. The bypass assembly can include a slip hanger disposed in a recess in an outer surface of the lower tubular anchor seal assembly, the slip hanger retaining the proximal end of the second hydraulic conduit.

The lower tubular anchor seal assembly can include a subsurface safety valve having a flow control member in communication with a port on an outer surface of the lower tubular anchor seal assembly, the port in communication with the upper hydraulic control line through an annulus formed between the lower tubular anchor seal assembly and the lower hydraulic nipple as bounded by a set of radial seals. The upper tubular anchor seal assembly can include a subsurface safety valve having a flow control member in communication with a port on an outer surface of the upper tubular anchor seal assembly, the port in communication with the lower hydraulic control line through an annulus formed between the upper tubular anchor seal assembly and the upper hydraulic nipple as bounded by a set of radial seals. The lower tubular anchor seal assembly can include a second lower hydraulic nipple therein in communication with the lower hydraulic control line. The upper tubular anchor seal assembly can include a second upper hydraulic nipple therein in communication with the upper hydraulic control line.

A method to inject a fluid into a well can include providing a production tubing in a well bore having an upper and a lower hydraulic nipple, the upper hydraulic nipple in communication with an upper hydraulic control line extending from a surface location and the lower hydraulic nipple in communication with a lower hydraulic control line extending from the surface location, installing an upper tubular anchor seal assembly into the upper hydraulic nipple, installing a lower tubular anchor seal assembly into the lower hydraulic nipple, connecting the upper and lower hydraulic nipples with a bypass passage extending therebetween, providing a first hydraulic conduit extending from the surface location to a stinger, wherein a proximal end of a second hydraulic conduit is connected to the lower tubular anchor seal assembly and a distal end of the second hydraulic conduit is disposed upstream of a distal end of the lower tubular anchor seal assembly, inserting the stinger into a receptacle bore of a receiving body housed in the upper tubular anchor seal assembly, and injecting the fluid through the first hydraulic control line, out a stinger port on an outer surface of the stinger, through an upper bypass pathway in the upper tubular anchor seal assembly, into the upper hydraulic nipple, through the bypass passage into the lower hydraulic nipple, through a lower bypass pathway in the lower tubular anchor seal assembly, and out a distal end of a second hydraulic conduit, the proximal end of the second hydraulic conduit in communication with the lower bypass pathway. The method can include suspending the second hydraulic conduit from a slip hanger disposed in a recess in an outer surface of the lower tubular anchor seal assembly. The method can include actuating a flow control member of a subsurface safety valve disposed in the upper tubular anchor seal assembly with the upper hydraulic control line. The method can include actuating a flow control member of a subsurface safety valve disposed in the lower tubular anchor seal assembly with the lower hydraulic control line. At least one of the installing steps can be via wireline.

DETAILED DESCRIPTION OF THE PREFERRED EMBODIMENTS

Figure 1:
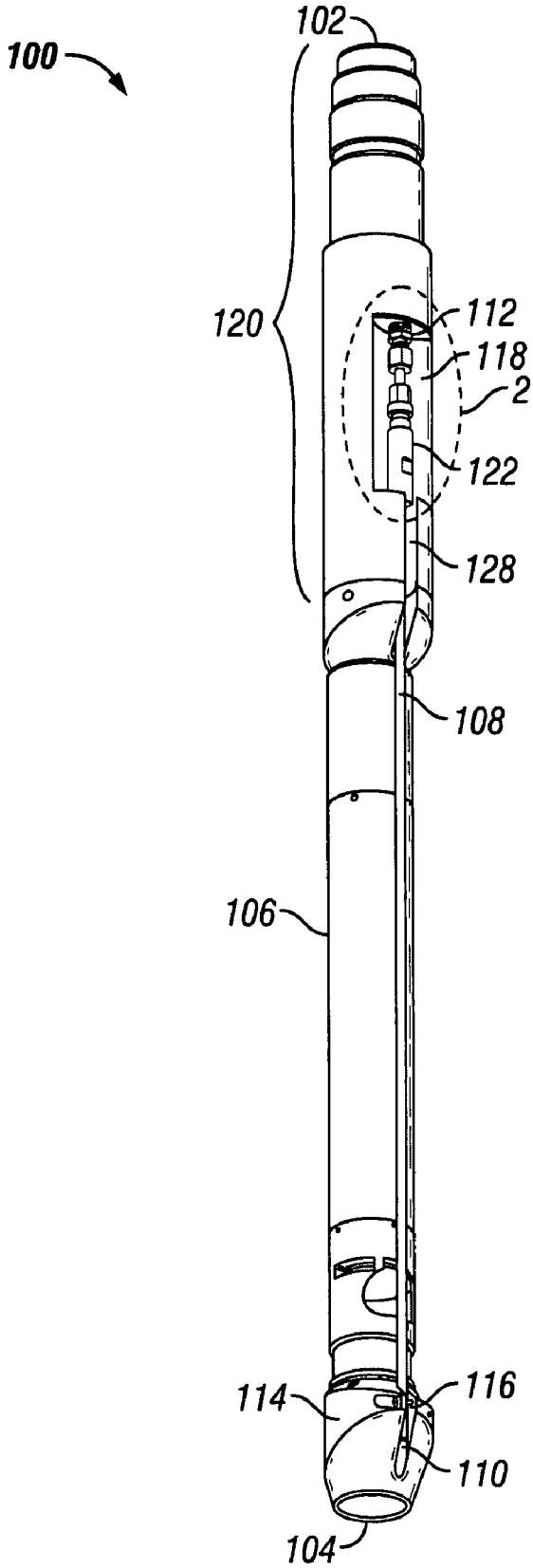
FIG. 1 is a perspective view a bypass assembly in accordance with one embodiment of the invention.
Figure 2:
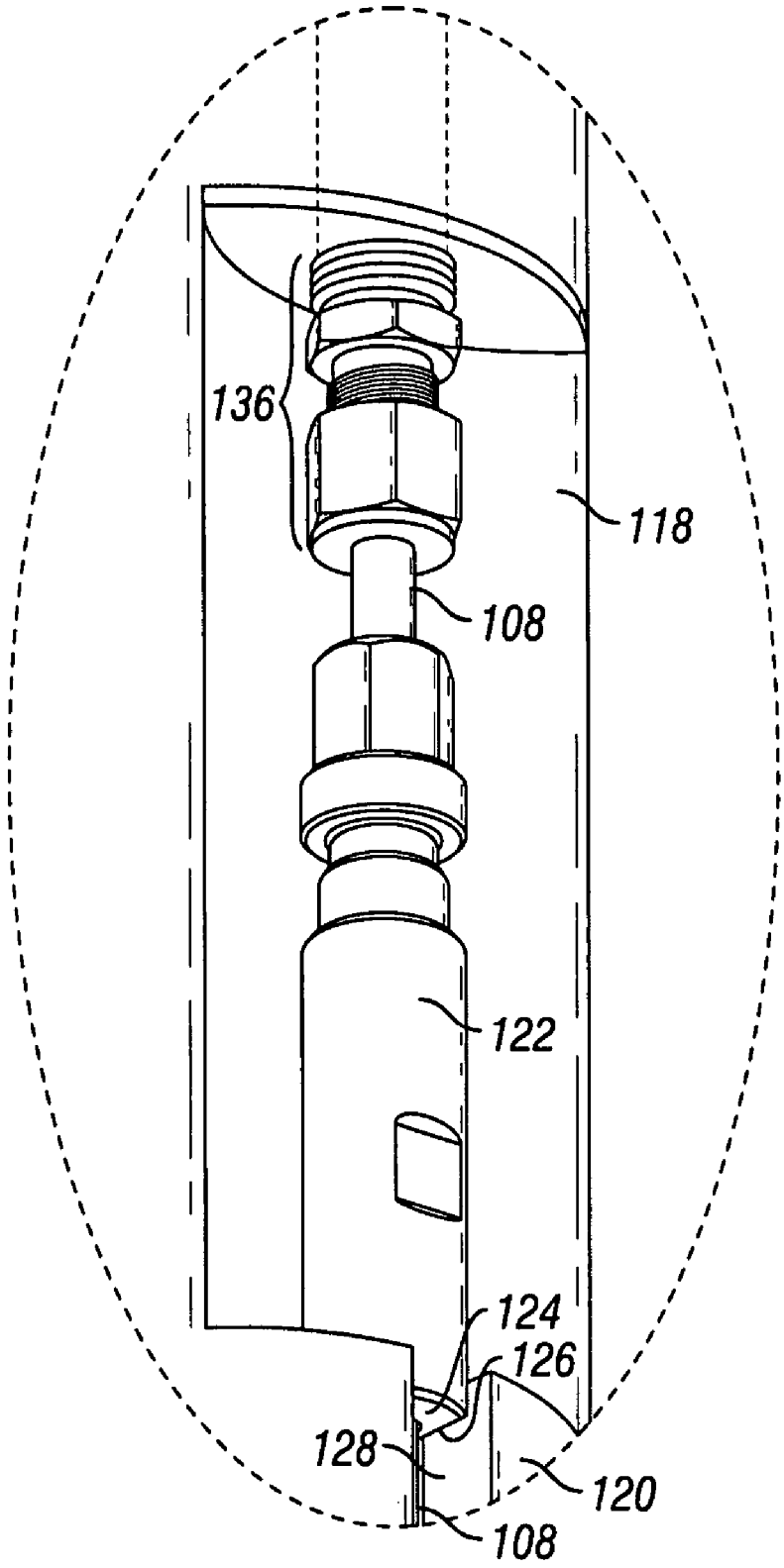
FIG. 2 is a close-up perspective view of a slip hanger connected to the bypass assembly of FIG. 1.

Referring initially to FIG. 1, a slip hanging bypass assembly 100 to inject a fluid in a well is shown. Fluid bypass assembly 100 is preferably sealably retained within a string of production tubing to allow fluid to bypass tube 106, and thus anything in the bore of tube 106. As a sting of production tubing typically has a landing profile for receiving an anchor assembly, the bypass assembly 100 can include, or be attached to, an anchor assembly, for example, on proximal end 102, for retention in a well, A hydraulic nipple type of landing profile and respective anchor assembly removably received therein can be seen in FIG. 16, however the invention is not so limited. Any type of anchor assembly can be used to retain a bypass assembly 100 in a production tubing. If so desired, a seal can be formed between said anchor assembly and the production tubing so as to route the flow of fluids in a production tubing through the longitudinal bore of the bypass assembly 100. Similarly, the outer surface of bypass assembly 100 itself can include a seal or packer element to seal the outer surface of bypass assembly 100 to the bore of a string of production tubing.

Tube 106 can contain, or be, any downhole component including, but not limited to, valves, whipstocks, packers, plugs, sliding side doors, flow control devices, expansion joints, on/off attachments, landing nipples, dual completion components, and other tubing retrievable completion equipment. Bypass assembly 100 allows a hydraulic conduit 108, to be in communication below tube 106, independent of the inner bore of tube 106 allowing fluid flow. For example, if tube 106 is a subsurface safety valve, bypass assembly 100 allows a fluid to be injected from proximal end 102, through hydraulic conduit 108 to distal end 110, independent of the position of any flow control member housed in tube 106. Although tube 106 is described in the embodiment of a subsurface safety valve, tube 106 can be any downhole component, and further is not limited to tubular shapes. Hydraulic conduit 108, which can be a capillary tube or other small diameter tubing, can extend below distal end 104 of bypass assembly 100 if so desired. For example, the distal end 110 of the hydraulic conduit 108 can extend downward through the bore of production tubing into a production zone of a wellbore. Distal end 110 of hydraulic conduit 108 can include an injection head (not shown), as is known to one of ordinary skill in the art. An optional skid or ring 114 can be installed to distal end of tube 106. Ring 114 includes a groove 116 to allow the passage of hydraulic conduit 108. Groove 116 and/or ring 114 can be selected so that an outer diameter of ring 114 extends radially beyond hydraulic conduit 108 to protect said hydraulic conduit 108 from damage, for example, to protect from crushing contact with the bore of a production tubing wherein bypass assembly 100 is being disposed.

Figure 6:
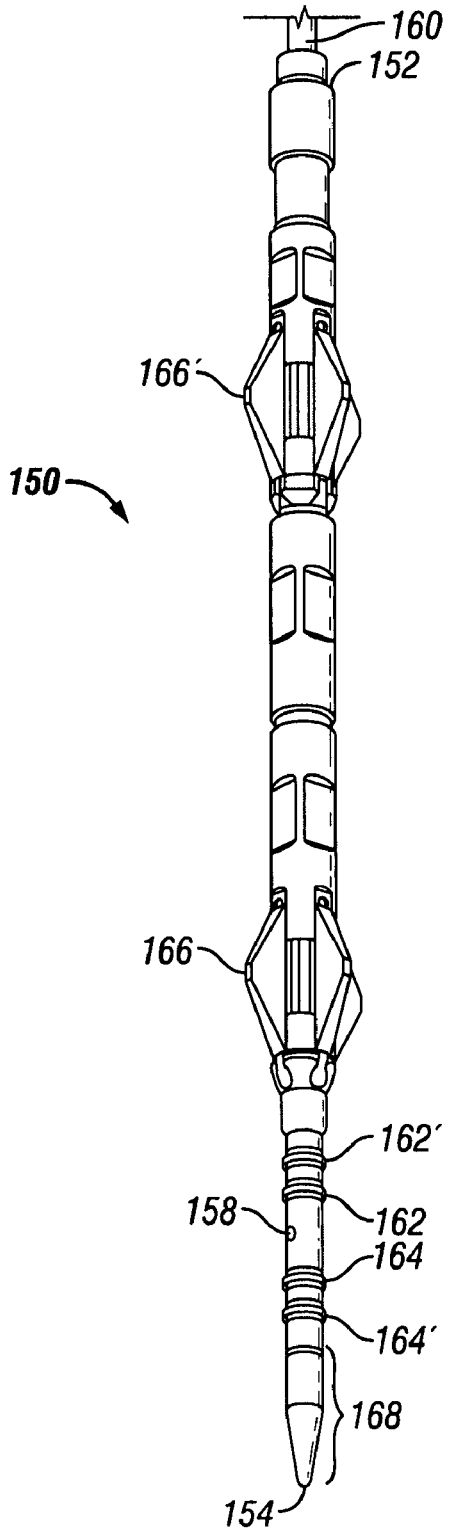
FIG. 6 is a perspective view of a stinger according to one embodiment of the invention.
Figure 7:
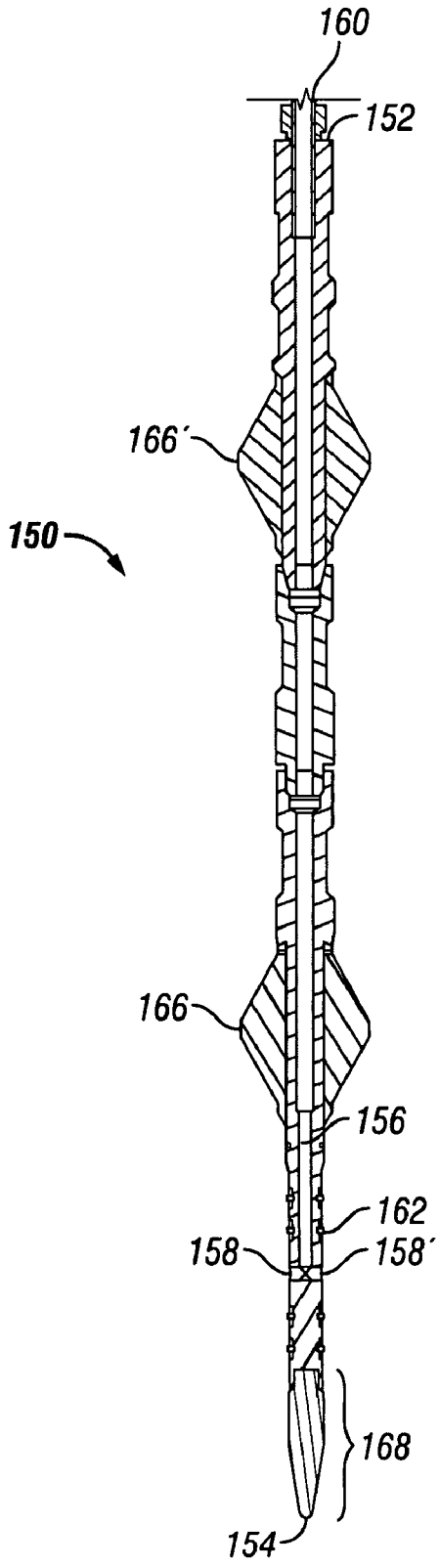
FIG. 7 is a section view of the stinger of FIG. 6.

In the embodiment shown, bypass assembly 100 includes a tubular receiver 120 for removably receiving a stinger 150 (see FIGS. 6-7). Tubular receiver 120 includes a receiving body 170 (shown more clearly in FIGS. 10-11) enabling stinger 150 to communicate with hydraulic conduit 108 while still allowing flow through the longitudinal bore 180. Receiving body 170 can be connected to, or formed as part of, tubular receiver 120 by any means know to one of ordinary skill in art. As hydraulic conduit 108 can extend any length into a well from tubular receiver 120, a length of hydraulic conduit 108 utilized can result in a substantial weight supported by the bypass assembly 100. To provide support, the tubular receiver 120 includes a slip hanger 122 to suspend the hydraulic conduit 108 therefrom.

Turning now to FIGS. 2-5, further detail of slip hanger 122 is provided. Although a distal end 124 of slip hanger 122 is illustrated as being supportably retained by a socket 126 formed in a distal wall of the recess 118 of tubular receiver 120, any means of connecting slip hanger 122 to the bypass assembly 100 sufficient to support the weight of hydraulic conduit 108 can be used. Groove 128 allows the passage of hydraulic conduit 108 and can provide protection to said hydraulic conduit 108, for example, from contact with a bore of a production tubing during the disposition of the bypass assembly 100 into said production tubing. If tube 106 has an outer diameter large enough to impede the linear path of hydraulic conduit 108, a groove can also be added into outer surface of tube 106, similar to groove 128 in tubular receiver 120.

Figure 3:
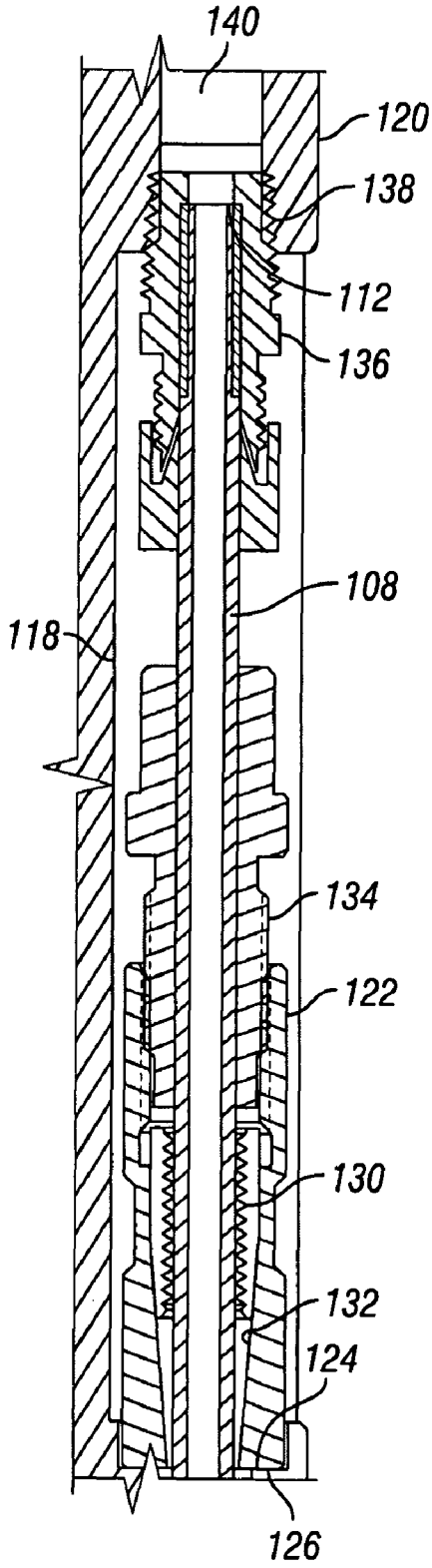
FIG. 3 is a sectional view of the slip hanger of FIG. 2.

FIG. 3 is a sectional view illustrating slip hanger 122. Slip hanger 122 includes a tapered bore 132 engaging slips 130, as is known to one of ordinary skill in the art. An axial load towards the narrowly tapered end of the tapered bore 132, typically referenced as downhole, imparts a frictional interaction between the outer surface of hydraulic conduit 108 and the inner surface of the slips 130 to impede movement therebetween. In such an engagement, the weight of hydraulic conduit 108 is substantially supported by slip hanger 122 instead of connector 136. Connector 136 connects to second bypass port 138 of bypass pathway. Connector 136 is typically insufficient to support an extended length of hydraulic conduit 108.

Figure 4:
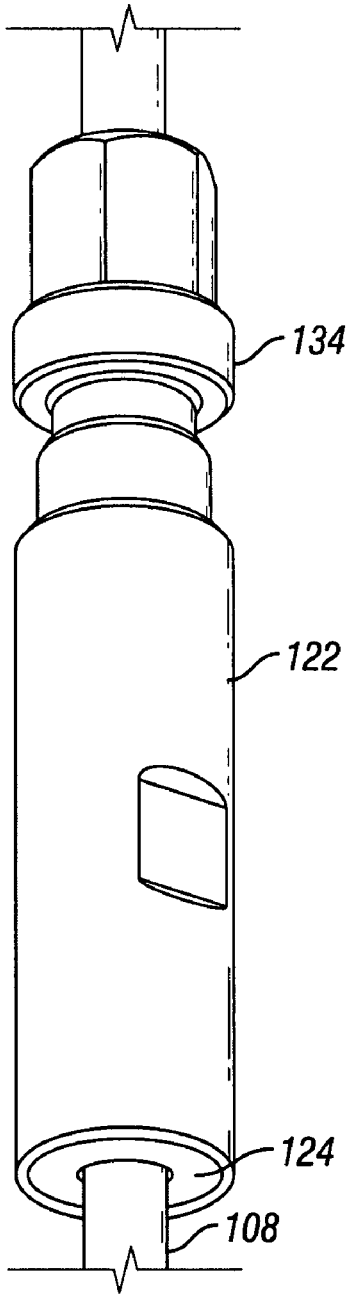
FIG. 4 is a close-up perspective view of the slip hanger of FIG. 2 disconnected from the bypass assembly.
Figure 5:
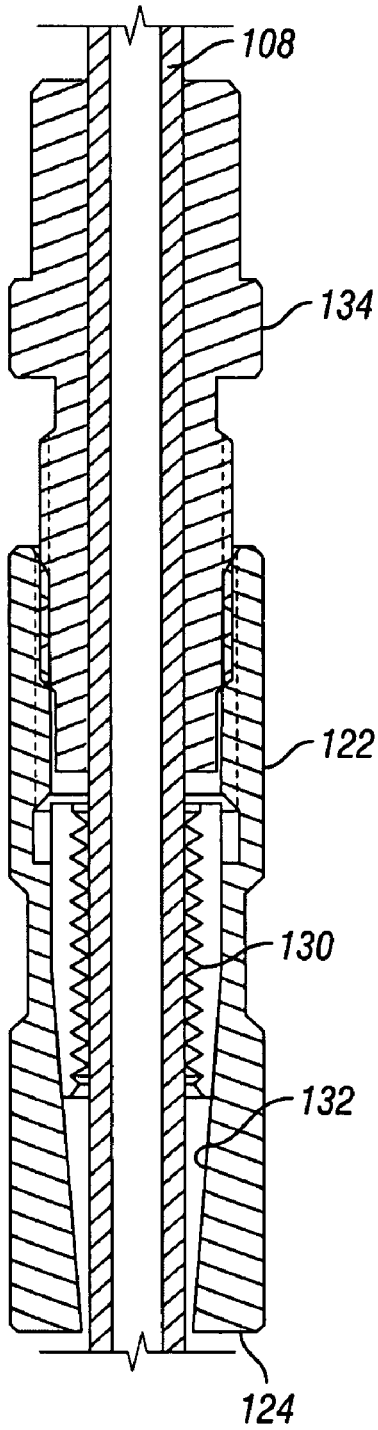
FIG. 5 is a sectional view of the slip hanger of FIG. 4.

Connector 136 provides a sealed connection between proximal end 112 of hydraulic conduit 108 and second bypass port 138 of bypass pathway 140 of the tubular receiver 120, further discussed below in reference to FIGS. 8-11. Second bypass port 138 is preferably formed in a proximal end of recess 118. Optional fitting 134 is provided to retain slips 130 within tapered bore 132 of the slip hanger 122, for example, during insertion of hydraulic conduit 108. FIG. 4 illustrates the circular profile of distal end 124 of slip hanger 122. FIG. 5 is a close-up view of the hydraulic conduit 108 retained by slips 130 of slip hanger 122.

Referring now to FIGS. 6-7, one embodiment of a stinger 150 is illustrated. Stinger 150 provides a fluid passage 156 having a connection on a proximal end 152 to a conduit 160 that typically extends to the surface to supply the fluid to be injected, for example. Fluid passage 156 of stinger 150 is in further communication with a stinger port(s) (158, 158') in the outer surface of stinger 150. Although two stinger ports (158, 158') are shown, one or more stinger ports (158, 158') can be utilized without departing from the spirit of the invention. A set of radial seals (162, 164) is provided to facilitate sealing engagement with receptacle bore 172 of receiving body 170, described below in detail in reference to FIG. 8. A second set of radial seals (162', 164') can optionally be included if further sealing is desired. Alignment fins (166, 166') can be added to the outer surface of the stinger 150 to facilitate insertion of said stinger 150 into the receptacle bore 172 of receiving body 170. Although each set of adjacent alignment fins (166 or 166') is illustrated with four fins, any plurality of alignment fins (166, 166') can be used without departing from the spirit of the invention. Two sets of alignment fins (166, 166') are shown, but any single or plurality of sets of alignment fins (166, 166') can be employed on the stinger 150. Outermost portion of alignment fins (166, 166') can contact the longitudinal bore 180 of tubular receiver 120 to align the stinger 150 and receptacle bore 172. Alignment is not limited to fins, and any alignment apparatus can be utilized without departing form the spirit of the invention. Distal end 154 of stinger 150 can include a conical nose cone 168 to further aid insertion into the receptacle bore 172 of receiving body 170.

Figure 8:
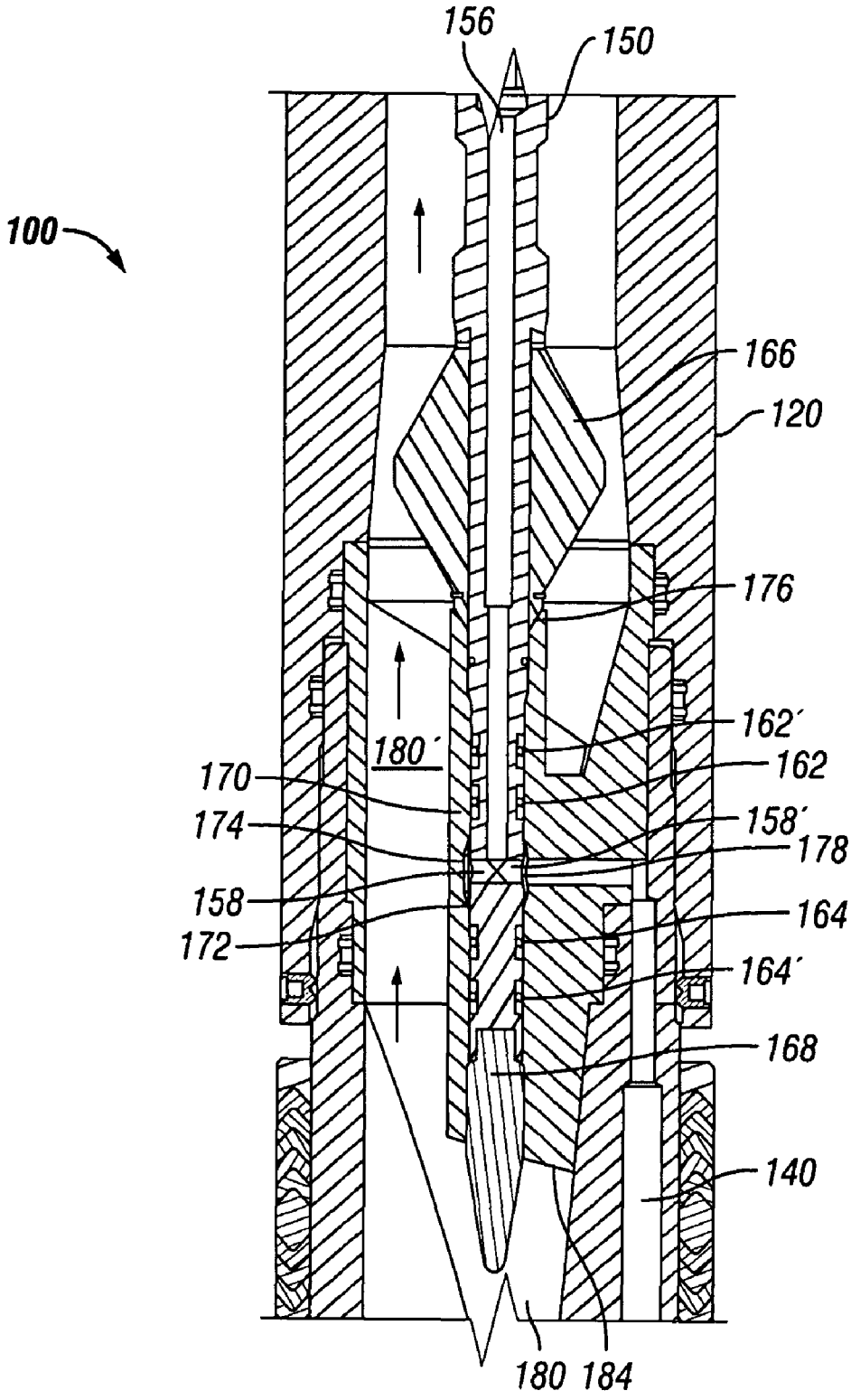
FIG. 8 is a sectional view of a stinger disposed in the receptacle bore of a two piece tubular receiver of a bypass assembly, according to one embodiment of the invention.

FIG. 8 illustrates a stinger 150 removably received within receptacle bore 172 of receiving body 170. When so assembled, bypass assembly 100 permits a fluid injected through stinger 150 to flow into bypass pathway 140, which is in communication with hydraulic conduit 108, said hydraulic conduit 108 extending into the production tubing upstream of the bypass assembly 100. Stinger 150 is inserted into the receptacle bore 172 until stinger port(s) (158, 158') are in communication with first bypass port 178. First bypass port 178 is formed in receptacle bore 172 and is in communication with bypass pathway 140. Shoulder 176 formed on the outer surface of the stinger 150 axially limits the insertion of stinger 150 into receptacle bore 172 due to contact with a respective shoulder in proximal end of receiving body 170. A further added benefit of axially limiting the insertion of the stinger 150 with a shoulder 176 or any limiting means known in the art is the axial alignment of the stinger port (158, 158') With first bypass port 178. Radial alignment of a stinger port (158, 158') with first bypass port 178 is not required in the illustrated embodiment utilizing radial seals (162,164; 162', 164').

Referring now to FIGS. 8-11, to facilitate communication between a stinger port (158, 158'), and thus the connected conduit 160, and the first bypass port 178, and thus the connected hydraulic conduit 108; at least one radial seal (162, 162') is disposed on a proximal portion of the stinger 150 as referenced from the stinger ports (158, 158') and at least one radial seal (164, 164') is disposed on a distal portion of the stinger 150 as referenced from the stinger ports (158,158'). In such an arrangement, a fluid injected through the fluid passage 156 of the stinger 150, flows out of the stinger ports (158, 158') and into an annulus formed between the receptacle bore 172 and the outer surface of the stinger 150, said annulus bounded by the set of radial seals (e.g., proximal radial seal 162 and distal radial seal 164). The fluid injected in the annulus can then flow into first bypass port 178 in the receptacle bore 172, into the connected bypass pathway 140, and out hydraulic conduit 108 into the well. Optionally, circumferential cavity 174 can be formed in receptacle bore 172 adjacent the first bypass port 178 to aid the flow of injected fluid by providing a larger void between the receptacle bore 172 and the outer surface of the stinger 150. Although shown disposed in a receiving groove in the outer surface of the stinger 150, radial seals (162, 164; 162', 164') can be disposed in a receiving groove in the receptacle bore 172 without departing from the spirit of the invention. The invention is not limited to the embodiment employing radial seals (162, 164; 162', 164') as any seal means providing communication between a stinger port (e.g., stinger port 158') and first bypass port 178 can be used. In such an embodiment, radial alignment of the stinger port 158' with first bypass port 178 can be achieved by any means known in the art.

Figure 9:
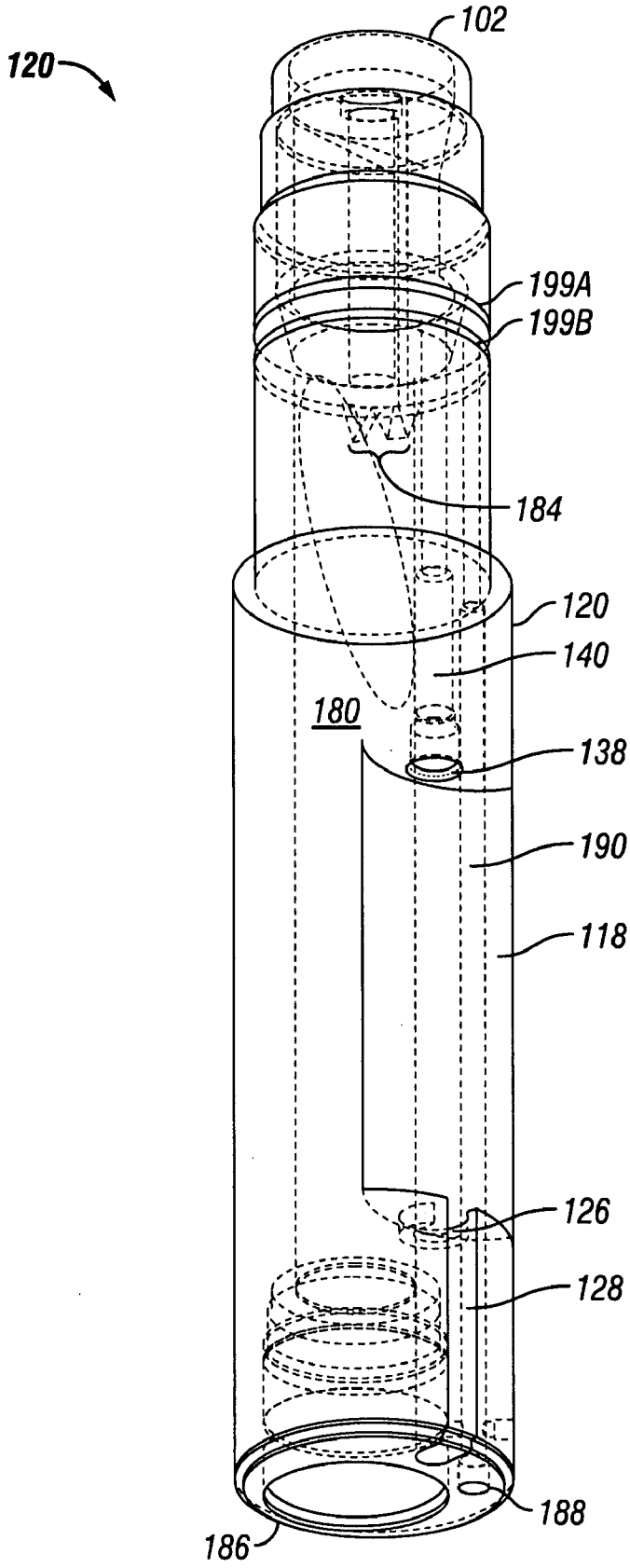
FIG. 9 is a schematic view of a two piece tubular receiver of a bypass assembly, according to one embodiment of the invention.

As tubular receiver 120 is preferably sealably retained in a production tubing, any well fluid flowing through said production tubing is diverted through longitudinal bore 180 of tubular receiver 120. Distal end 186 of longitudinal bore 180 of tubular receiver 120 is in communication with the longitudinal bore of tube 106 (see FIG. 1). Longitudinal bore 180 of tubular receiver 120 can be more readily seen in FIGS. 1-11. Receiving body 170, with or without stinger 150 engaged therein, is fixed within the longitudinal bore 180 of tubular receiver 120. As receiving body 170 is an impediment to fluid flow through longitudinal bore 180 of tubular receiver 120, the portion of longitudinal bore 180 adjacent the receiving body 170 can flare to a larger diameter. The resulting flared flow bore 180' portion of longitudinal bore 180 adjacent the receiving body 170 can thus be sized to allow Substantially the same flow as the portion of longitudinal bore 180 of original (e.g., non-flared) diameter. FIG. 11 is a view of the proximal end 102 of tubular receiver 120, showing the profile of flow bore 180' and stinger receptacle bore 172. As shown in FIGS. 9 and 11, distal end 184 of receiving body 170 can be formed to minimize the flow disruption of receiving body 170. For example, distal (e.g., upstream) end 184 of receiving body 170 can have a pointed tip similar to the bow of a ship, or any other profile to maximize fluid flow though longitudinal bore 180. Although receiving body 170 is shown mounted askew to the longitudinal axis of the distal portion of longitudinal bore 180 of tubular receiver 120, receiving body 170 can be in any position and/or location in the longitudinal bore 180 of the tubular receiver 120.

As shown more readily in FIG. 9, an optional second pathway 190 extending through tubular receiver 120 allows communication from a proximal end 102 of tubular receiver 120 to a port 188 on distal end 186 of tubular receiver 120. As distal end 186 of tubular receiver typically has tube 106 attached thereto, a conduit extending to proximal end 102 of tubular receiver 120 can be in communication with tube 106 through port 188 of second pathway 190. In such an embodiment, any hydraulically actuated device within tube 106, for example, a closure member of a subsurface safety valve, can be actuated through second pathway 190. Further, instead of tube 106 being a subsurface safety valve, the longitudinal bore of attached tube 106 can have a landing profile formed therein, such a landing profile, typically referred to as a landing nipple, can be a hydraulic nipple by providing a conduit in the tube 106 extending from landing profile to port 188 to enable communication with second pathway 190.

Figure 12:
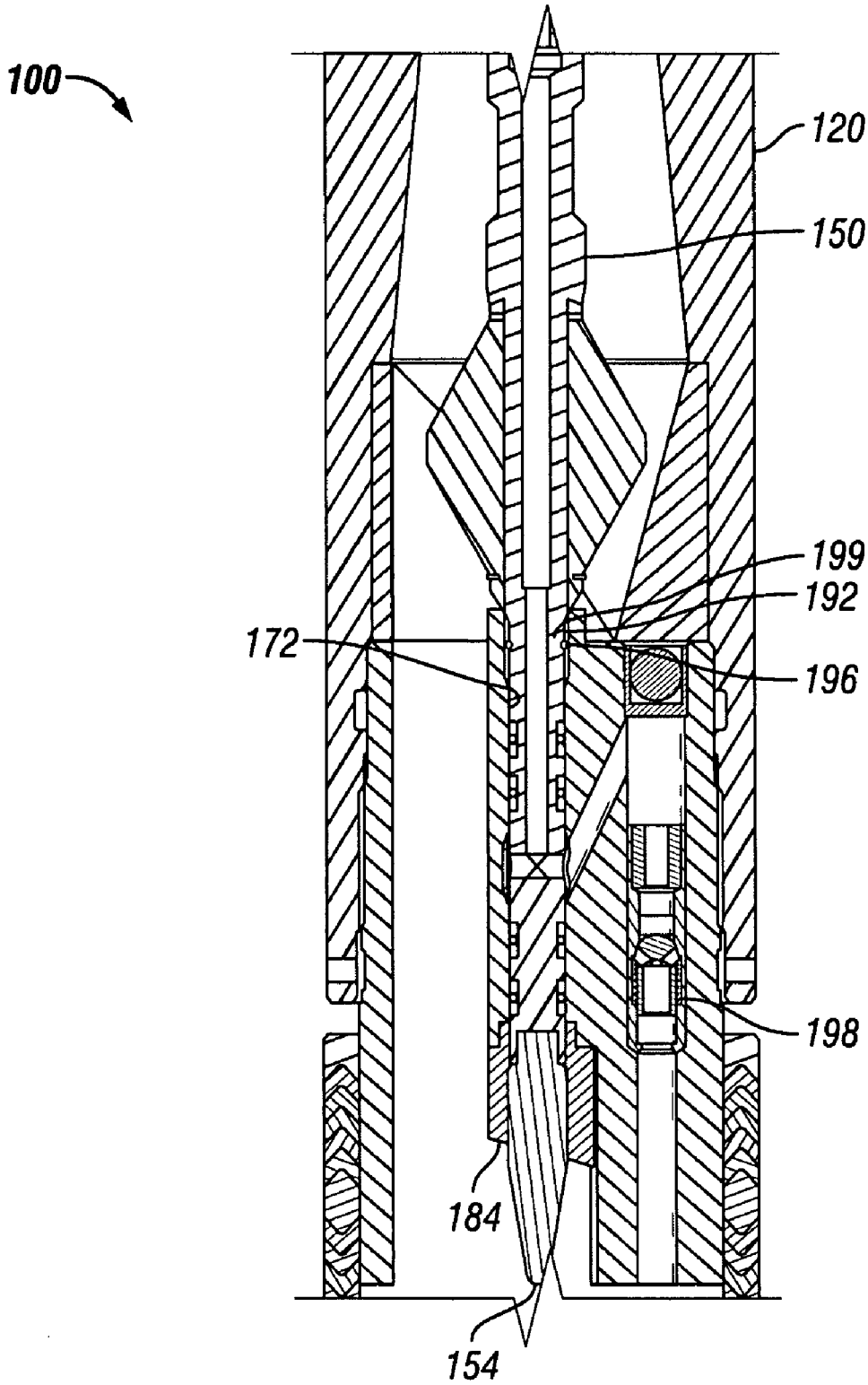
FIG. 12 is a sectional view of a stinger disposed in the receptacle bore of a one piece tubular receiver of a bypass assembly, according to one embodiment of the invention.

FIG. 12 is another embodiment of a tubular receiver 120 with a stinger 150 engaged therein. A mechanical lock is added between the outer surface of the stinger 150 and the receptacle bore 172 to retain the stinger 150 therein. The mechanical lock shown is a locking ring 192. Locking ring 192 is disposed in a groove 194 in stinger 150 and received by a respective groove 196 formed in receptacle bore 172. Grooves (194, 196) and locking ring 192 can be selected of material composition and/or geometry sufficient to form an interlock retaining stinger 150 within receptacle bore 172. If retrieval of stinger 150 is desired, the stinger 150 can be axially loaded, for example through attached conduit 160 from the surface location or an attached wireline, to disconnect the mechanical lock. For example, locking ring 192 can be selected to fail or disconnect at a desired level of force to allow the release of stinger 150 from receptacle bore 172 of tubular receiver 120. Although one embodiment of a mechanical lock is illustrated, any means for locking stinger 150 within receiver tube 120 can be utilized. Further, stinger 150 is not required to extend through distal end 184 of receiving body 170 as shown. Distal end 184 of receiving body 170 can be formed without a port for the stinger 150 to exit such that distal end 184 of receiving body 170 encompasses the distal end 154 of the stinger 150 to shield the distal end 154 from the flow of well fluids.

Figure 18:
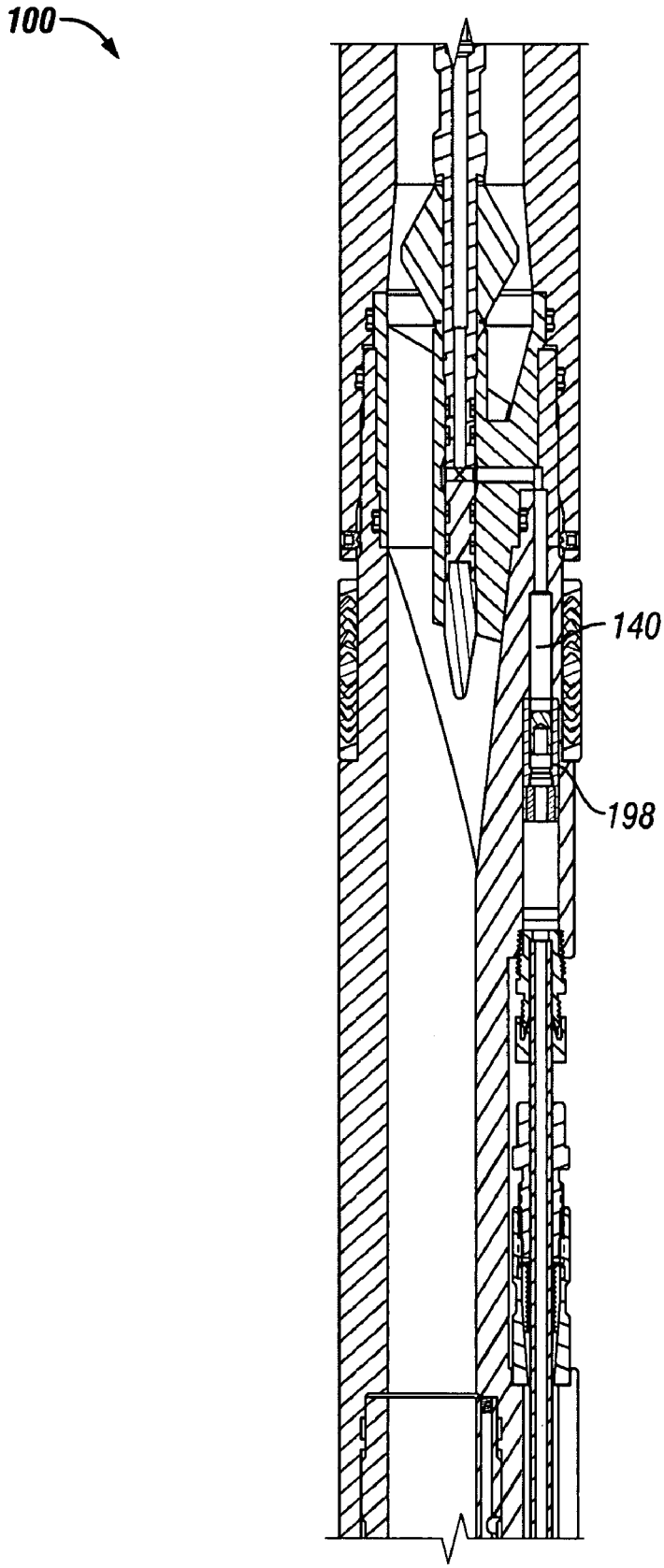
FIG. 18 is a sectional view of a stinger disposed in the receptacle bore of a two piece tubular receiver of a bypass assembly including a bypass pathway check valve, according to one embodiment of the invention.

FIGS. 12 and 18 further illustrate a check valve 198 in bypass pathway 140 to impede the flow of fluids into bypass pathway 140 from second bypass port 138. Although so illustrated, at least one check valve can be included with any fluidic conduit of, or connected to, bypass assembly 100. For example, a check valve can be added to hydraulic conduit 108.

Figure 10:
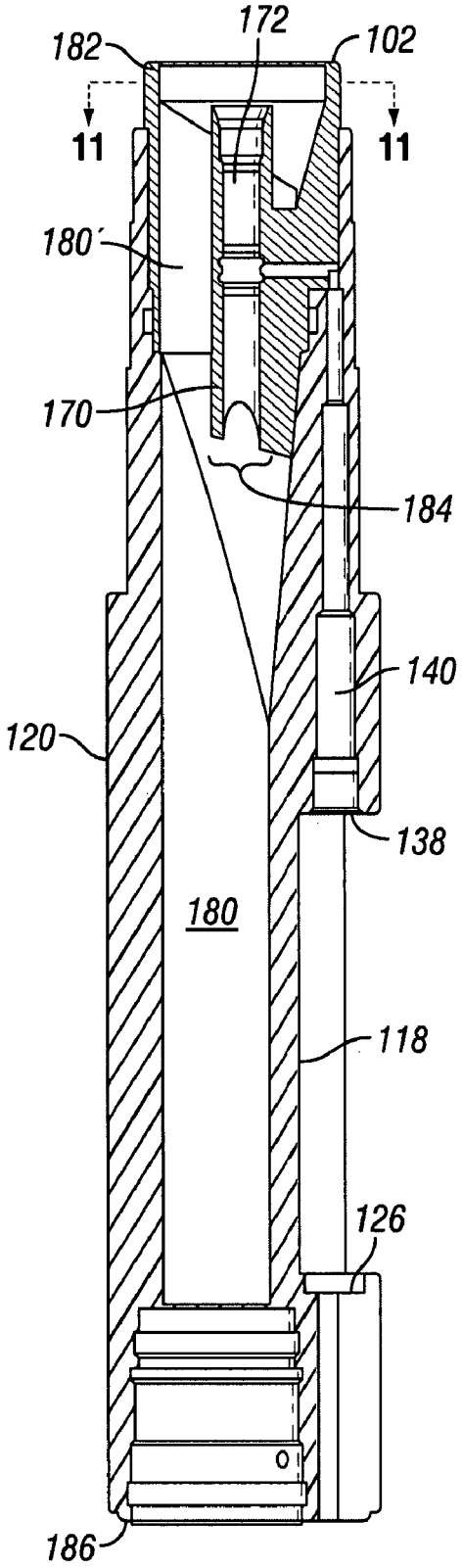
FIG. 10 is a sectional view of the two piece tubular receiver of FIG. 9.
Figure 11:
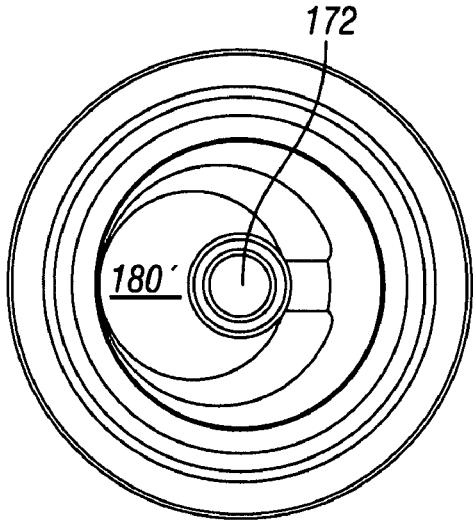
FIG. 11 is a transverse sectional view of the two piece tubular receiver of FIG. 10, as seen along the lines 11-11.
Figure 13:
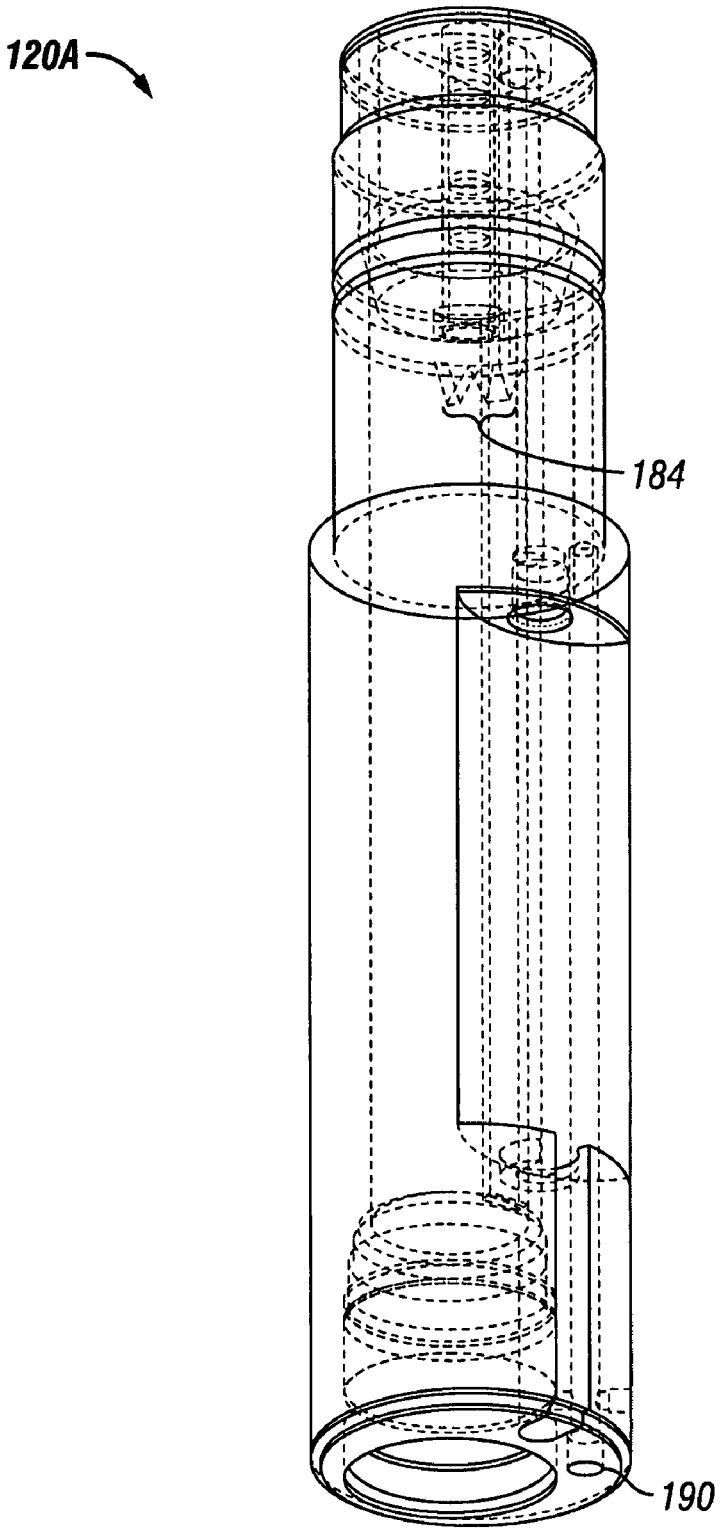
FIG. 13 is a schematic view of a one piece tubular receiver of a bypass assembly, according to one embodiment of the invention.
Figure 14:
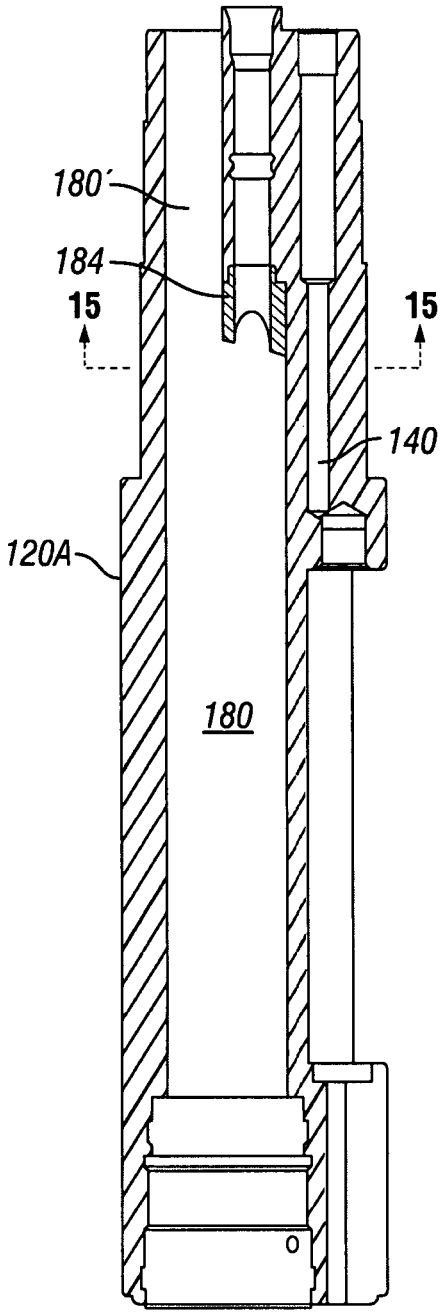
FIG. 14 is a sectional view of the one piece tubular receiver of FIG. 13.
Figure 15:
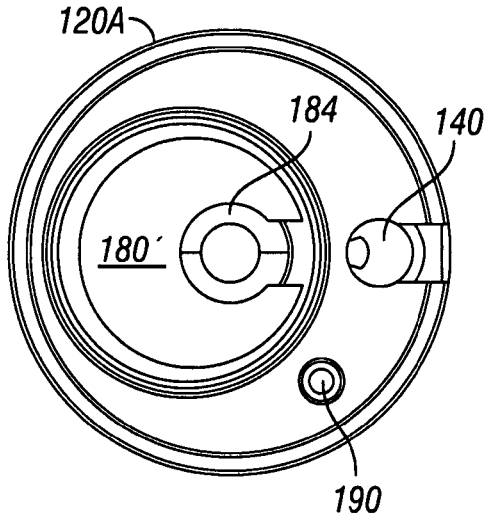
FIG. 15 is a transverse sectional view of the one piece tubular receiver of FIG. 14, as seen along the lines 15-15.

Tubular receiver 120 in FIGS. 9-11 is a two piece tubular receiver. Receiving body 170 of tubular receiver 120 containing receptacle bore 172 being a separate body 182 which attaches to the other body to form tubular receiver 120. FIGS. 13-15 illustrate a one piece tubular receiver 120A. Distal end 184 of receiving body 170 can be a separate component attached to receiving body 170 is shown, for example, to form distal end portion 184 out of a hardened and/or a fluidic abrasion resistant material. Although illustrated as a single and dual piece tubular receiver, one of ordinary skill in the art will appreciate than any plurality of components can be used to form the tubular receiver (120, 120A) or any component of the bypass assembly 100.

To assemble bypass assembly 100 of FIGS. 1-11, a tubular receiver 120 is provided. A desired length of hydraulic conduit 108 is connected to tubular receiver 120. The distal end 110 of hydraulic conduit 108, which can include an injection head attached thereto, is disposed into production tubing, before, during, or after the connection to the slip hanger 122 of tubular receiver 120 is made. Proximal end 112 of hydraulic conduit 108 is disposed though slip hanger 122 and connector 136 is attached to proximal end 112. Slip hanger 122 can then be inserted into socket 126 (see FIG. 9) formed in recess 118 of tubular receiver 120, more specifically, distal end 124 of slip hanger 122 is received by a socket 126 sufficient to support any load imparted by the length of hydraulic conduit 108 hanging therebelow.

Tube 106, which can be a subsurface safety valve or a landing profile, for example, is connected to distal end 186 of tubular receiver 120. Tube 106 and tubular receiver 120 can be formed as a single piece, if so desired. Tube 106 and tubular receiver 120 can be joined by any connection know in the art. If tube 106 includes a hydraulically actuated device, for example, a closure member of a subsurface safety valve 106, port 188 on distal end 186 of tubular receiver 120 can be connected to said hydraulically actuated device. As second pathway 190 connects port 188 to a conduit, for example, a hydraulic control line extending from a surface location, the hydraulically actuated device in tube 106 can be actuated through said hydraulic control line. In the configuration shown in FIG. 1, a hydraulic control line extending to the tube 106 would be external to the outer surface of tubular receiver 120 and consequently be exposed to damage during the installation of tubular receiver 120 into a production tubing. By using a second pathway 190 internal to the tubular receiver 120 wall, such a hydraulic control line is protected from crushing contact between the outer surface of tubular receiver 120 and production tubing housing said tubular receiver 120.

Similarly, second pathway 190 can connect to a conduit, for example, a hydraulic control line, by communication with a hydraulic nipple. By adding an anchor, as described in reference to FIGS. 16-17, to tubular receiver 120, tubular receiver can be retained within the landing profile of the hydraulic nipple. As shown in FIG. 9, radial seals can be mounted in grooves (199A, 199B) to provide a seal with the bore of the hydraulic nipple. A port on the outer surface of tubular receiver 120 between the radial seals (199A, 199B) allows communication with a port formed in the bore of the hydraulic nipple. So assembled, any conduit extending to the port in the bore of the hydraulic nipple is in communication with second pathway 190, port 188, and thus any conduit of tube 106 attached to distal end 186 of tubular receiver 120.

By utilizing a tubular receiver 120 having an outer diameter at least equal to the outer diameter of the tube 106 plus the outer diameter of hydraulic conduit 108, the hydraulic conduit 108 can extend substantially linearly from slip hanger 122 (e.g., when disposed in socket 126). A groove 128 in outer surface of tubular receiver 120 allows for protection of hydraulic conduit 108, for example, from the crushing of the hydraulic conduit 108 by contact with a production tubing bore. For further protection, an optional ring 114 having an outer diameter similar to the outer diameter of the tubular receiver 120 and a groove 116 similar to groove 128 can be installed on a distal end of tube 106 to provide further protection of hydraulic conduit 108. Grooves (116, 128) are preferably radially aligned. Such an assembly, as shown in FIG. 1, can then be attached to an anchor assembly, as further described in reference to the embodiment shown in FIGS. 16-17. Anchor assembly is preferably attached to proximal end 102 of the assembly of FIG. 1. A well, or more specifically, production tubing, typically has a corresponding landing profile to receive said anchor assembly.

Bypass assembly 100, without stinger 150, can then be disposed into the production tubing. As the bypass assembly 100 does not require the running of new production tubing, the operation can be performed via wireline, which is typically substantially less expensive than a coiled tubing job or other in-well operation. Bypass assembly 100 without stinger 150, is disposed into the production tubing and engaged within a landing profile, which can be a hydraulic nipple. After installation, well fluid can then be flowed through the production tubing with the well fluid flow routed though longitudinal bore of tube 106 and longitudinal bore 180 of tubular receiver 120, including flow bore 180'. In such a configuration, if tube 106 is a subsurface safety valve, the flow in the production tubing can be controlled by actuating the flow control member of the subsurface safety valve.

Stinger 150 enables fluid to be injected into the well from a surface location. Stinger 150 is attached to a distal end of a conduit 160, however a conduit and stinger can be formed as a unitary assembly. Stinger 150 is then inserted into the production tubing by any means known in the art and lowered until received by the receptacle bore 172. As shown in FIG. 8, alignment fins 166 can be used to aid alignment of stinger 150 and receptacle bore 172. A mechanical lock between the stinger 150 and receptacle bore 172 can be engaged, for example, the stinger locking ring 192 and receptacle bore groove 196 in FIG. 12.

Fluid can then be pumped from the surface location through conduit 160, into fluid passage 156 of stinger 150, and exit stinger ports (158, 158'). As radial seals (162, 164) seal the annulus between stinger 150 and receptacle bore 172, the fluid is injected into first bypass port 178, similarly located between radial seals (162, 164). Fluid from first bypass port 178 can then flow into bypass pathway 140 which extends through the tubular receiver 120 and into a hydraulic conduit 108 attached to second bypass port 138, shown more readily in FIG. 3. Fluid can therefore be injected through hydraulic conduit 108 to any desired location in the well. As hydraulic conduit 108 does not extend within tube 106, any downhole component contained in the bore of tube 106, or any downhole component substituted for tube 106, is bypassed. Weight of stinger 150, axial load from conduit 160, and/or a mechanical lock can retain stinger 150 within receptacle bore 172, for example, to resist the force imparted by the fluid injection. Bypass assembly 100 allows a downhole component (e.g., element 106) in a well to be bypassed. Stinger 150 can be removed at any time if so desired, for example, before removal of tubular receiver 120 and attached tube 106 from production tubing.

Longitudinal bore of tube 106, for example, a subsurface safety valve, is in communication with longitudinal bore 180 of tubular receiver 120. By sealably retaining said tube 106 and tubular receiver 120 assembly within production tubing, any fluid flowing through the production tubing is routed through the longitudinal bores thereof. If tube 106 is a subsurface safety valve, for example, any flow control member thereof can be actuated to restrict flow of fluid thought the longitudinal bores, and thus restrict flow within the production tubing. Bypass assembly 100 allows injection of fluid into the upstream zone (e.g., the zone sealed from the surface by flow control member of a subsurface safety valve embodiment of tube 106) though the hydraulic conduit 108 hung from tubular receiver 120. As bypass assembly 100, including stinger 150, attached conduit 160, and hydraulic injection conduit 108, is totally contained within the bore of production tubing, no injection lines are required to be run outside of the production tubing.

Well fluids typically flow through production tubing at a high velocity that can erode any body extending into the flow path of said well fluids. Turning again to FIG. 8, optional alignment fins 166 are made of a soft material, for example, aluminum, that is substantially removable or otherwise can be eroded or abraded by flow of a well fluid. As alignment fins 166 can impede the flow of fluid through the longitudinal bore 180 of tubular receiver 120, such removal of alignment fins 166 after engagement within receptacle bore 172 can be achieved. As further illustrated in FIG. 8, to impede abrasion or erosion of stinger 150, the conical nose section 168 exposed to flow of well fluid can be formed of, or be coated with, an erosion resistant material, for example, carbide. As more readily discernable from FIG. 15, distal end 184 of receiving body 170 can be formed of, or be coated with, an erosion resistant material, for example, carbide and/or distal end 184 can be shaped to minimize drag, and thus minimize erosion, as is known by one of ordinary skill in the art.

Figure 16:
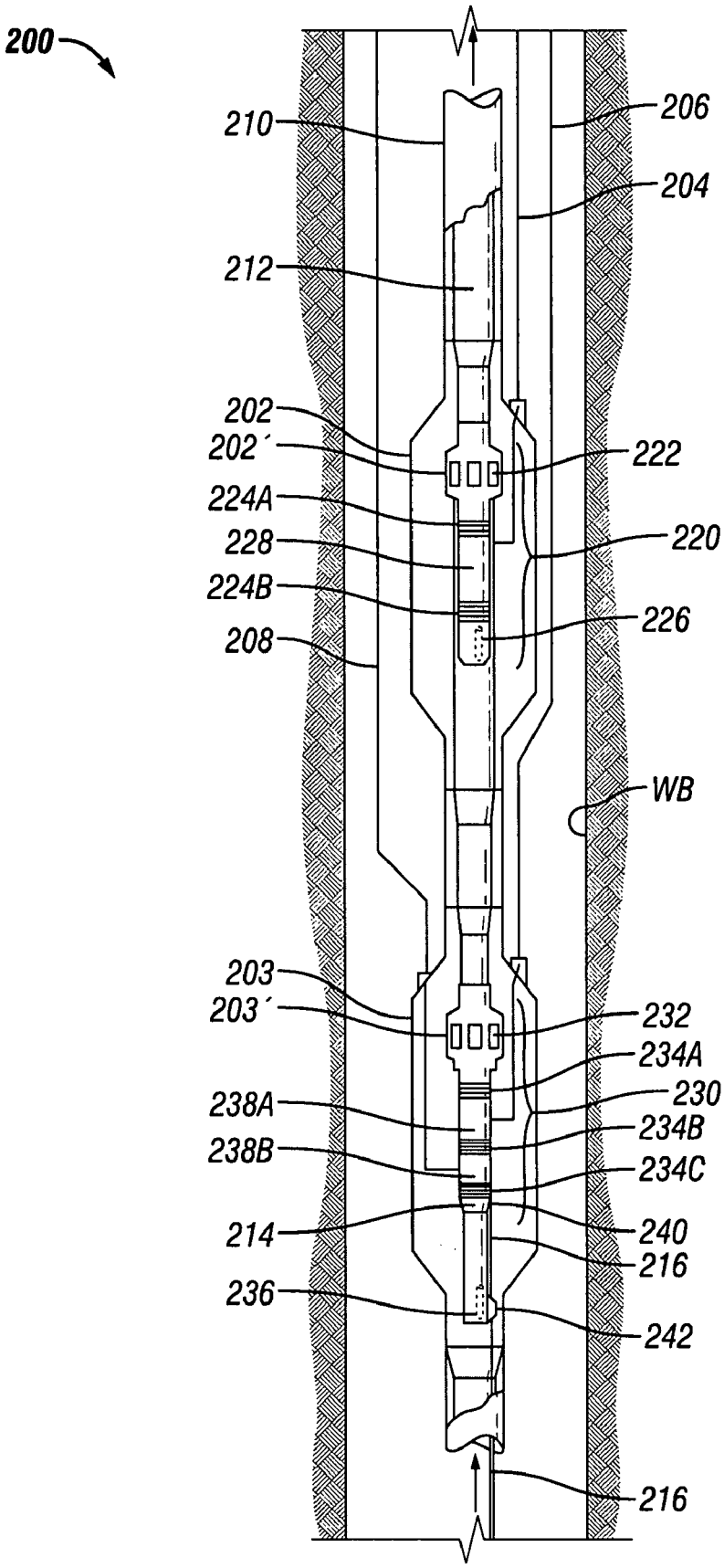
FIG. 16 is a schematic view of a bypass assembly installed in a production tubing of a well, according to one embodiment of the invention.

FIG. 16 illustrates a second embodiment of a bypass assembly 200. Production tubing 210, disposed in wellbore WB, includes dual landing profiles (202, 203), shown here as hydraulic landing profiles also referred to as hydraulic nipples. Hydraulic nipples (202, 203) serve as landing profiles to retain downhole components, typically subsurface safety valves, while providing a conduit extending thereto for communicating with the downhole component retained therein. Dual landing profiles (202, 203) are advantageous when dual subsurface safety valves are desired. For example, as an assembly retained in a hydraulic nipple (202, 203) can be an impediment to access through the production tubing 210, the assembly can be retrieved from the surface to allow access to the production tubing 210. Upper 202 and/or lower 203 hydraulic nipples can be formed as part of production tubing 210, or as a sub assemblies threaded, or otherwise attached, inline with production tubing 210 as shown.

Upper hydraulic nipple 202 includes landing profile 202'. Upper hydraulic control line 204 extends from a surface location to the upper hydraulic nipple 202, more specifically, to a port in the bore of the upper hydraulic nipple 202.

Lower hydraulic nipple 203 includes landing profile 203'. Lower hydraulic control line 206 extends from a surface location to the lower hydraulic nipple 203, more specifically, to a port in the bore of the lower hydraulic nipple 203. First hydraulic conduit 208 extends from a surface location to lower hydraulic nipple 203, more specifically a second port (e.g., a bypass port) in the bore of the lower hydraulic nipple 203. Upper hydraulic control line 204, lower hydraulic control line 206, and first hydraulic conduit 208 preferably extend from the production tubing 210 to the surface location through the annulus formed between the wellbore WB and the outer surface of production tubing 210, but can be a pathway within the wall of production tubing 210.

Upper tubular anchor seal assembly 220 includes an anchor 222 to engage within upper landing profile 202'. A port in outer surface of upper tubular anchor seal assembly 220 is bounded by a set of radial seals (224A, 224B) between the outer surface of the upper tubular anchor seal assembly 220 and the bore of the upper hydraulic nipple 202. As the zone 228 therebetween includes a port in the bore of the upper hydraulic nipple 202 in communication with the upper hydraulic control line 204, fluid can be provided to the upper tubular anchor seal assembly 220.

For example, if upper tubular anchor seal assembly 220 is a subsurface safety valve, the flow control member 226 can be in communication with the port in the outer surface of upper tubular anchor seal assembly 220. So configured, upper hydraulic control line 204 can be used to actuate flow control member 226. If the upper tubular anchor seal assembly 220 provides a second upper hydraulic nipple in the bore thereof, upper hydraulic control line 204 can similarly provide fluid to allow actuation of a downhole component anchored in second upper hydraulic nipple (not shown). Although upper 202 and lower 203 hydraulic nipples are shown in close proximity, they can be spaced at any distance therebetween.

Upstream from upper tubular anchor seal assembly 220, is lower tubular anchor seal assembly 230. Lower tubular anchor seal assembly 230 includes an anchor 232 to engage within lower landing profile 203'. A first port in outer surface of lower tubular anchor seal assembly 230 is bounded by a set of radial seals (234A. 234B) between the outer surface of the lower tubular anchor seal assembly 230 and the bore of the lower hydraulic nipple 203. As the zone 238A therebetween includes a port in the bore of the lower hydraulic nipple 203 in communication with the lower hydraulic control line 206, fluid can be provided to the lower tubular anchor seal assembly 230.

For example, if lower tubular anchor seal assembly 230 is a subsurface safety valve, the flow control member 236 can be in communication with the port in the outer surface of lower tubular anchor seal assembly 230 in zone 238A. So configured, lower hydraulic control line 206 can be used to actuate flow control member 236. If the lower tubular anchor seal assembly 230 is a second lower hydraulic nipple, lower hydraulic control line 206 can similarly provide fluid to allow actuation of a downhole component anchored in second lower hydraulic nipple (not shown).

Lower tubular anchor seal assembly 230 of bypass assembly 200 further includes a bypass pathway 214 therethrough. First hydraulic conduit 208 extends from the surface location to the first bypass port in the bore of the lower hydraulic nipple 203.

A second bypass port of bypass pathway 214, in outer surface of lower tubular anchor seal assembly 230, is bounded by a set of radial seals (234B, 234C) between the outer surface of the lower tubular anchor seal assembly 230 and the bore of the lower hydraulic nipple 203. As the zone 238B therebetween includes a first bypass port in the bore of the lower hydraulic nipple 203 in communication with the first hydraulic conduit 208, fluid can be provided to the bypass pathway 214. Bypass pathway 214 extends to a port on the outer surface of lower tubular anchor seal assembly 230, said port providing a connection to a second hydraulic conduit 216. As second hydraulic conduit 216 extends external to flow control member 236, fluid can be injected from a surface location, through first hydraulic conduit 208, bypass pathway 214, second hydraulic conduit 216, and into the wellbore WB. Slip hanger 240, similar to the slip hanger described in reference to FIGS. 1-5, can be used to support second hydraulic conduit 216, the slip hanger disposed in a recess in the outer surface of the lower tubular anchor seal assembly 230. Skid 242 with a groove receiving the second hydraulic conduit 216 can be optionally be used, similar to ring 114 in the embodiment shown in FIG. 1, to protect hydraulic conduit 216 from contact with the bore of the production tubing during the insertion of the lower tubular anchor seal assembly 230 into said production tubing. Ring 114 and/or skid 242 can be used with any embodiment of the invention to protect a hydraulic conduit, which can be capillary tubing.

The set of radial seals (234A, 234B; 234B, 234C) bounding zone 238A (e.g., flow control member 236 actuation) and zone 238B (e.g., fluid injection) can utilize a common radial seal 234B therebetween as shown, or separate radial seals (Le., replace radial seal 234B with two separate radial seals).

To use bypass assembly 200, production tubing 210 with upper 202 and lower 203 hydraulic nipples is disposed in a wellbore WB. Upper tubular anchor seal assembly 220 and lower tubular anchor seal assembly 230 are disposed within longitudinal bore 212 of production tubing 210 and engaged within the respective upper 202 and lower 203 hydraulic nipples, preferably the lower tubular anchor seal assembly 230 installed first. The operation can be performed via wireline, which is typically Substantially less expensive than a coiled tubing job or other in-well operations. Second hydraulic conduit 216 is preferably connected to lower tubular anchor seal assembly 230 at the surface location. Well fluid flowing through longitudinal bore 212 of production tubing 210 is routed through the longitudinal bores of upper tubular anchor seal assembly 220 and lower tubular anchor seal assembly 230 by seals of each tubular anchor seal assembly. Flow control members (226, 236) of the bypass assembly 200 can be actuated from the surface location through upper 204 and lower 206 hydraulic control lines respectively, to regulate the flow of well fluid through longitudinal bore 212 of production tubing 210. Fluid can be injected into the well through first hydraulic conduit 208, bypass pathway 214, second hydraulic conduit 216, and into the wellbore WB independent of the position of either flow control member (226, 236).

Although illustrated with subsurface safety valve embodiment of tubular anchor seal assemblies (220, 230), an anchor seal assembly can include any combination of anchor (222, 232) and downhole component(s). An anchor seal assembly can be non-tubular without departing from the spirit of the invention.

Figure 17:
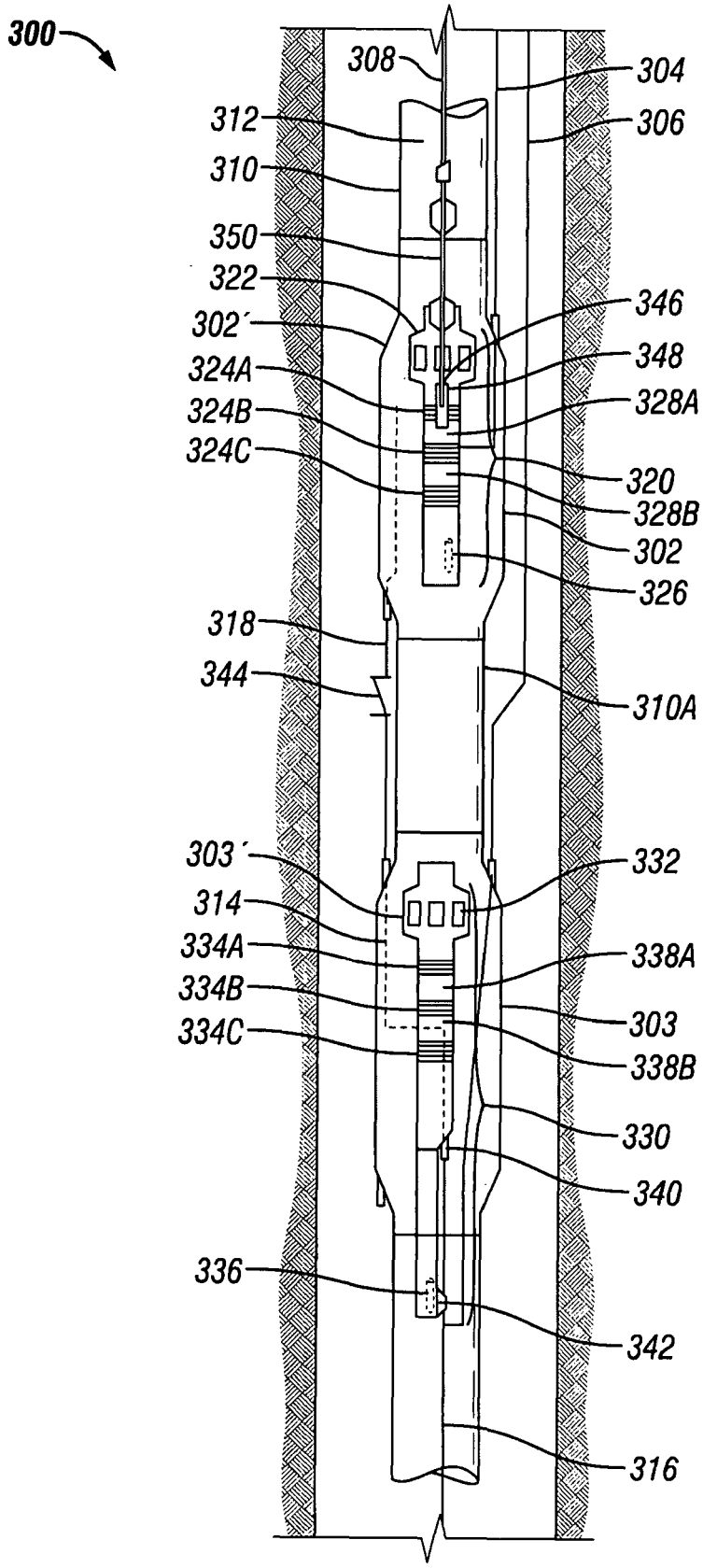
FIG. 17 is a schematic view of a bypass assembly installed in a production tubing of a well, according to one embodiment of the invention.

FIG. 17 illustrates a third embodiment of a bypass assembly 300. Production tubing 310, disposed in wellbore WB, includes dual landing profiles (302, 303), shown here as hydraulic landing profiles also referred to as hydraulic nipples. Hydraulic nipples (302, 303) serve as landing profiles to retain downhole components, typically subsurface safety valves, while providing a conduit extending thereto for communicating with the downhole component retained therein. Dual landing profiles (302, 303) are advantageous when dual subsurface safety valves are desired. For example, as an assembly retained in a hydraulic nipple (302, 303) can be an impediment to access through the production tubing 310, the assembly can be retrieved from the surface to allow access to the production tubing 310. Upper 302 and/or lower 303 hydraulic nipples can be formed as part of production tubing 310, or as a sub assemblies threaded, or otherwise attached, inline with production tubing 310 as shown.

Upper hydraulic nipple 302 includes landing profile 302'. Lower hydraulic nipple 303 includes landing profile 303'. Bypass passage 318 fluidicly connects upper 302 and lower 303 hydraulic nipples. More specifically, a proximal end of bypass passage 318 connects to a bypass port in the bore of the upper hydraulic nipple 302 and a distal end of bypass passage 318 connects to a bypass port in the bore of the lower hydraulic nipple 303. The entire length of bypass passage 318 can extend external to the production tubing 310 as shown, or a pathway within production tubing 310 wall (not shown) for protection if desired. In the embodiment shown, the larger outer diameter of hydraulic nipples (302, 303) and the smaller outer diameter of production tubing therebetween 310A, aids in protecting bypass passage 310 from contact with a wellbore WB during insertion therein.

First hydraulic conduit 308 extends from a surface location to a stinger 350 received by a receptacle bore 348 of a receiving body 346 in upper tubular anchor seal assembly 320. Port(s) in stinger 350, similar to the one shown in FIGS. 6-7, seal within receptacle bore 348 to provide communication with a port on the outer surface of the upper tubular anchor seal assembly 320. A set of radial seals between stinger 350 and receptacle bore 348 (similar to receptacle bore 172 shown in FIG. 8) allows fluid injected from a stinger port(s) to flow into a bypass pathway (similar to bypass pathway 140 in FIG. 8) and out the port in the exterior surface of the upper tubular anchor seal assembly 320. A set of radial seals (324A, 324B)

between outer surface of upper tubular anchor seal assembly 320 and bore of upper hydraulic nipple 302 form a zone 328A therebetween and allow the port in zone 328A on the outer surface of the upper tubular anchor seal assembly 320 to communicate with a port in the bore of the upper hydraulic nipple 302 in communication with bypass passage 318. Bypass passage 318 is in further communication with a port in the bore of the lower hydraulic nipple 303, said port in communication with a port on the outer surface of the lower tubular anchor seal assembly 330 in the zone 338B bounded by set of radial seals (334B, 334C). Port on the outer surface of the lower tubular anchor seal assembly 330 is in communication with a bypass pathway 314 extending through the lower tubular anchor seal assembly 330. Bypass pathway 314 extends to a second port on the surface of lower tubular anchor seal assembly 330 below any radial seals (334A, 334B, 334C), said port connected to a proximal end of a second hydraulic conduit 316. Distal end of the second hydraulic conduit 316 extends into the wellbore WB, typically below lower hydraulic nipple 303.

Upper hydraulic control line 304 extends from a surface location to the upper hydraulic nipple 302, more specifically, to a port in the bore of the upper hydraulic nipple 302. Set of radial seals (324B, 324C) bounding zone 328B enable fluid to be injected from the port in the bore of the upper hydraulic nipple 302 into a port in the outer surface of upper tubular anchor seal assembly 320.

For example, if upper tubular anchor seal assembly 320 is a subsurface safety valve, the flow control member 326 can be in communication with the port in the outer surface of upper tubular anchor seal assembly 320. So configured, upper hydraulic control line 304 can be used to actuate flow control member 326. If the upper tubular anchor seal assembly 320 is a second upper hydraulic nipple, upper hydraulic control line 304 can similarly provide fluid to allow actuation of a downhole component anchored in second upper hydraulic nipple (not shown).

Lower hydraulic control line 306 extends from a surface location to the lower hydraulic nipple 303, more specifically, to a port in the bore of the lower hydraulic nipple 303. Set of radial seals (334A, 334B ) bounding zone 338A enable fluid to be injected from the port in the bore of the lower hydraulic nipple 303 into a port in the outer surface of lower tubular anchor seal assembly 330.

For example, if lower tubular anchor seal assembly 330 is a subsurface safety valve, the flow control member 336 can be in communication with the port in the outer surface of lower tubular anchor seal assembly 330 in zone 338A. So configured, lower hydraulic control line 306 can be used to actuate flow control member 336. If the lower tubular anchor seal assembly 330 is a second lower hydraulic nipple, lower hydraulic control line 306 can similarly provide fluid to allow actuation of a downhole component anchored in second lower hydraulic nipple (not shown).

Upper hydraulic control line 304 and lower hydraulic control line 306 preferably extend from the production tubing 310 to the surface location through the annulus formed between the wellbore WB and the outer surface of production tubing 310, but can be a pathway within the wall of production tubing 310. Although upper 302 and lower 303 hydraulic nipples are shown in close proximity, they can be any distance therebetween.

Slip hanger 340, similar to the slip hanger described in reference to FIGS. 1-5, can be used to support second hydraulic conduit 316, the slip hanger disposed in a recess in the outer surface of the lower tubular anchor seal assembly 330. Skid 342 with a groove receiving the second hydraulic conduit 316 can optionally be used, similar to ring 114 in the embodiment shown in FIG. 1. Ring 114 and/or skid 342 can be used with any embodiment of the invention to protect hydraulic conduit.

The sets of radial seals (334A, 334B; 334B, 334C) bounding zone 338A (flow control member 336 actuation) and zone 338B (fluid injection) can utilize a common radial seal 334B therebetween as shown, or separate radial seals (e.g., replace radial seal 334B with two separate radial seals), as is also applicable to the sets of radial seals (324A, 324B; 324B, 324C) used between the upper hydraulic nipple 302 and upper tubular anchor seal assembly 320.

To use bypass assembly 300, production tubing 310 with upper 302 and lower 303 hydraulic nipples is disposed in a wellbore WB. Upper tubular anchor seal assembly 320 and lower tubular anchor seal assembly 330 are disposed within longitudinal bore 312 of production tubing 310 and engaged within the respective upper 302 and lower 303 hydraulic nipples, preferably the lower tubular anchor seal assembly 330 installed first. The operation can be performed via wireline, which is typically substantially less expensive than a coiled tubing job or other in-well operation. Second hydraulic conduit 316 is preferably connected to lower tubular anchor seal assembly 330 at the surface location. Well fluid flowing through longitudinal bore 312 of production tubing 310 is routed through the longitudinal bores of upper tubular anchor seal assembly 320 and lower tubular anchor seal assembly 330. Flow control members (326, 336) of bypass assembly 300 can be actuated from the surface location through upper 304 and lower 306 hydraulic control lines respectively, to regulate the flow of well fluid through longitudinal bore 312 of production tubing 310.

Fluid can be injected into the well through stinger 350. Stinger 350, attached to a first hydraulic conduit 308 extending from the surface location, is disposed within bore 312 of production tubing 310 and into receptacle bore 348 of a receiving body 346 of upper tubular anchor seal assembly 320. Stinger 350 is resultantly placed in communication with bypass passage 318, said bypass passage 318 in communication with second hydraulic conduit 316. Stinger 350 enables fluid to be injected into the wellbore WB through a distal end of second hydraulic conduit 316, independent of the position of either flow control member (326, 336).

Although illustrated with subsurface safety valve embodiment of anchor seal assembly (320, 330), an anchor seal assembly can include any combination of anchor (322, 332) and downhole component(s). An anchor seal assembly can be non-tubular without departing from the spirit of the invention.

Numerous embodiments and alternatives thereof have been disclosed. While the above disclosure includes the best mode belief in carrying out the invention as contemplated by the inventors, not all possible alternatives have been disclosed. For that reason, the scope and limitation of the present invention is not to be restricted to the above disclosure, but is instead to be defined and construed by the appended claims.

What is claimed is:

1. A bypass assembly to inject a fluid into a well, the bypass assembly being connectable within a string of production tubing, the bypass assembly comprising:

a tubular receiver having a longitudinal bore, the longitudinal bore housing a receiving body with a receptacle bore;

a stinger removably received by the receptacle bore, the stinger having a fluid passage therein in communication with a stinger port on an outer surface of the stinger; and a bypass pathway extending from a first bypass port in the receptacle bore to a second bypass port on an outer surface of the tubular receiver, the stinger port in communication with the first bypass port when the stinger is engaged within the receptacle bore wherein a proximal end of said stinger is configured to connect to a conduit disposed within said string of production tubing, the arrangement being such that, in use, fluid is capable of flowing from a surface location through the conduit into said fluid passage and out of the stinger port to said bypass pathway.

2. The bypass assembly of claim 1 further comprising an anchor assembly on a proximal end of the tubular receiver, the anchor assembly received by a landing profile of the well.

3. The bypass assembly of claim 1 wherein the tubular receiver is disposed inline with a production tubing in the well.

4. The bypass assembly of claim 1 further comprising a tube attached to a distal end of the tubular receiver, a longitudinal bore of the tube in communication with the longitudinal bore of the tubular receiver.

5. The bypass assembly of claim 4 further comprising a hydraulic conduit extending from the second bypass port to a second location adjacent a distal end of the tube.

6. The bypass assembly of claim 1 further comprising a mechanical lock between the outer surface of the stinger and the receptacle bore to retain the stinger therein.

7. A method to inject a fluid into a well comprising:

installing an anchor assembly connected to a tubular receiver having a longitudinal bore into a landing profile of the well, the longitudinal bore housing a receiving body with a receptacle bore;

disposing a stinger from a surface location, through the well, into the receptacle bore of the receiving body, the stinger providing a fluid passage in communication with the surface location and a stinger port on an outer surface of the stinger disposed between a set of radial seals; and injecting the fluid through the fluid passage of the stinger, out of the stinger port and into an annulus between the receptacle bore and the stinger as bounded by the set of radial seals, into a first bypass port in the receptacle bore in communication with a bypass pathway, and out a second bypass port on an outer surface of the tubular receiver.

8. The method of claim 7 wherein a distal end of the tubular receiver is attached to a tube, a longitudinal bore of the tube in communication with the longitudinal bore of the tubular receiver.

9. The method claim 8 wherein the step of injecting the fluid further comprises: injecting the fluid from the second bypass port into a hydraulic conduit extending from the second bypass port to a second location upstream of a distal end of the tube to bypass the longitudinal bore of the tube.

10. The method of claim 9 further comprising suspending the hydraulic conduit from a slip hanger disposed in a recess in the outer surface of the tubular receiver.

11. The method of claim 9 further comprising flowing a well fluid through a void formed between an assembly of the stinger and the receiving body and the longitudinal bore of the tubular receiver.

12. The method of claim 11 wherein the well fluid is flowed at a rate sufficient to abradably remove an aluminum alignment fin disposed on the outer surface of the stinger.

13. The method of claim 7 further comprising removing the stinger from the receptacle bore.

14. A bypass assembly comprising:

a production tubing in a wellbore having an upper and a lower hydraulic nipple;

an upper tubular anchor seal assembly engaged within the upper hydraulic nipple;

a lower tubular anchor seal assembly engaged within the lower hydraulic nipple;

an upper hydraulic control line extending from a surface location to the upper hydraulic nipple;

a lower hydraulic control line extending from the surface location to the lower hydraulic nipple;

a first hydraulic conduit extending from the surface location to a stinger, the stinger removably received by a receptacle bore of a receiving body housed in a bore of the upper tubular anchor seal assembly and the first hydraulic control line in communication with a stinger port on an outer surface of the stinger;

a bypass passage connecting the upper hydraulic nipple to the lower hydraulic nipple, the stinger port in communication with the upper hydraulic nipple; and a proximal end of a second hydraulic conduit connected to the lower tubular anchor seal assembly and in communication with the lower hydraulic nipple, a distal end of the second hydraulic conduit upstream of a distal end of the lower tubular anchor seal assembly.

15. The bypass assembly of claim 14 further comprising a slip hanger disposed in a recess in an outer surface of the lower tubular anchor seal assembly, the slip hanger retaining the proximal end of the second hydraulic conduit.

16. The bypass assembly of claim 14 wherein the lower tubular anchor seal assembly comprises a subsurface safety valve having a flow control member in communication with a port on an outer surface of the lower tubular anchor seal assembly, the port in communication with the upper hydraulic control line through an annulus formed between the lower tubular anchor seal assembly and the lower hydraulic nipple as bounded by a set of radial seals.

17. The bypass assembly of claim 14 wherein the upper tubular anchor seal assembly comprises a subsurface safety valve having a flow control member in communication with a port on an outer surface of the upper tubular anchor seal assembly, the port in communication with the lower hydraulic control line through an annulus formed between the upper tubular anchor seal assembly and the upper hydraulic nipple as bounded by a set of radial seals.

18. The bypass assembly of claim 14 wherein the lower tubular anchor seal assembly comprises a second lower hydraulic nipple therein in communication with the lower hydraulic control line.

19. The bypass assembly of claim 14 wherein the upper tubular anchor seal assembly comprises a second upper hydraulic nipple therein in communication with the upper hydraulic control line.

20. The bypass assembly of claim 1, wherein the stinger is capable of providing fluid communication with a surface location via a hydraulic tubing extending from the surface location to the stinger.

* * * * *